United States Patent [19]

Del Bon et al.

[11] Patent Number: 4,532,690

[45] Date of Patent: Aug. 6, 1985

[54] PROCESS FOR PRODUCING A VALVE-AND-LID ASSEMBLY

[76] Inventors: Luigi Del Bon, Feldstrasse 141; Franco Del Bon, Feldstrasse 139, both of 4663 Aarburg, Switzerland

[21] Appl. No.: 444,351

[22] Filed: Nov. 24, 1982

Related U.S. Application Data

[63] Continuation-in-part of Ser. No. 259,158, Apr. 30, 1981, Pat. No. 4,442,959, and a continuation-in-part of Ser. No. 347,321, Feb. 9, 1982, Pat. No. 4,493,444.

[30] Foreign Application Priority Data

Nov. 26, 1981 [IE] Ireland ..... 2780/81
Apr. 19, 1982 [IE] Ireland ..... 920/82

[51] Int. Cl.[3] ..... B23P 11/02

[52] U.S. Cl. ..... 29/451; 29/235; 29/453; 222/402.25

[58] Field of Search ..... 29/235, 451, 453, 157.1 R; 222/402.1, 402.25, 402.24, 402.22, 394

[56] References Cited

U.S. PATENT DOCUMENTS

| | | | |
|---|---|---|---|
| 2,585,438 | 2/1952 | Clingman | 29/451 UX |
| 2,761,593 | 9/1956 | Spiess, Jr. et al. | 222/402.25 |
| 2,845,203 | 7/1958 | Potash | 29/451 UX |
| 2,856,104 | 10/1958 | Spiess, Jr. et al. | 222/402.25 |
| 3,144,179 | 8/1964 | Gildone | 222/402.25 X |
| 3,283,963 | 11/1966 | Boyer et al. | 222/402.25 X |
| 3,348,742 | 10/1967 | Assalit | 222/402.25 X |
| 3,415,426 | 12/1968 | Kleveland | 222/402.24 X |
| 3,977,575 | 8/1976 | Macquire-Cooper | 222/402.24 X |

*Primary Examiner*—Charlie T. Moon
*Attorney, Agent, or Firm*—Heinrich W. Herzfeld

[57] ABSTRACT

A process is described for producing a valve-and-lid assembly composed of a lid and a valve body each of which has a determined configuration and is produced separately in finished condition, the valve body from a synthetic resin of physical properties similar to those of Hytrel, with a Shore hardness of about 78 to 92 when the valve body is to be assembled with an upper body portion resting on the outer lid face about a collar of the lid; and of about 70 to 92 when the valve body is to be introduced completely into the lid collar. The valve body is then placed partially into the collar, or on the mandrel of a pressure piston, and then abruptly struck by the piston to be rammed fully into the collar and stretched so that a lower head of the valve body is moved downwardly just out of a central lid opening at an internal collar end. The mandrel is then withdrawn, permitting the valve body to contract whereby its head sealingly engages the rim about the central opening of the collar.

12 Claims, 27 Drawing Figures

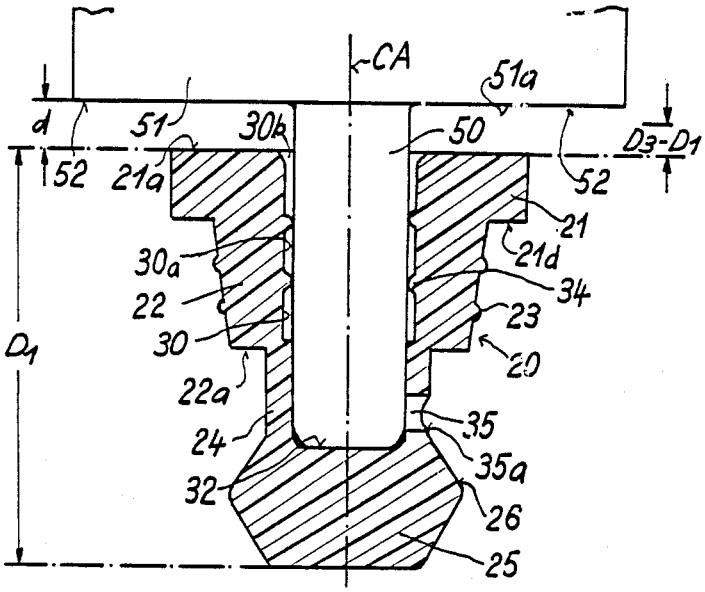
Fig. 1
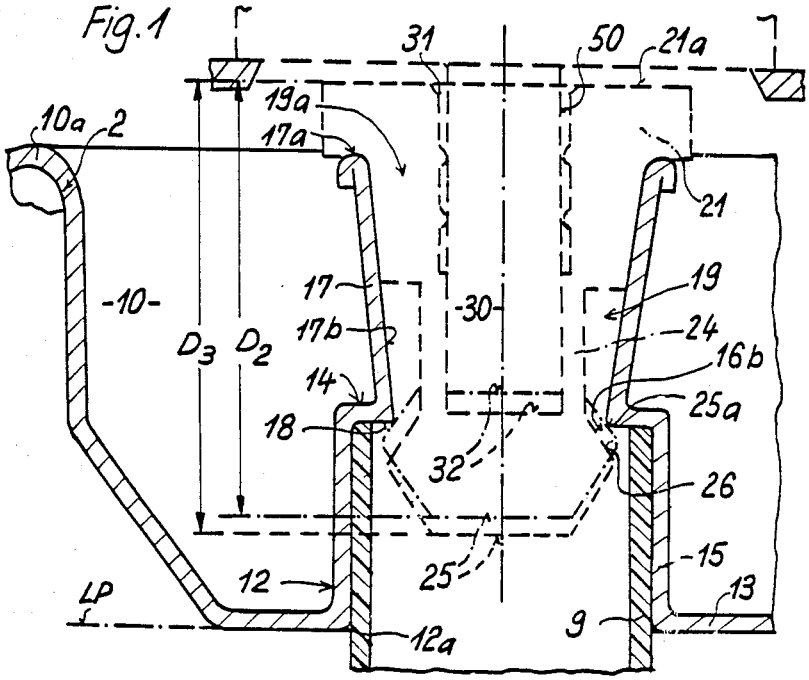

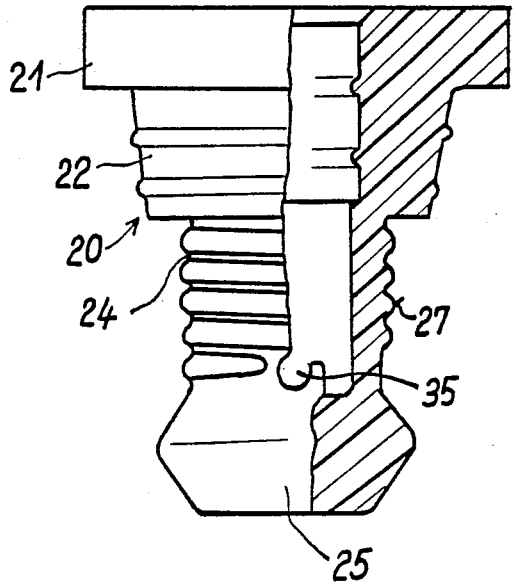
Fig.3
Fig.4
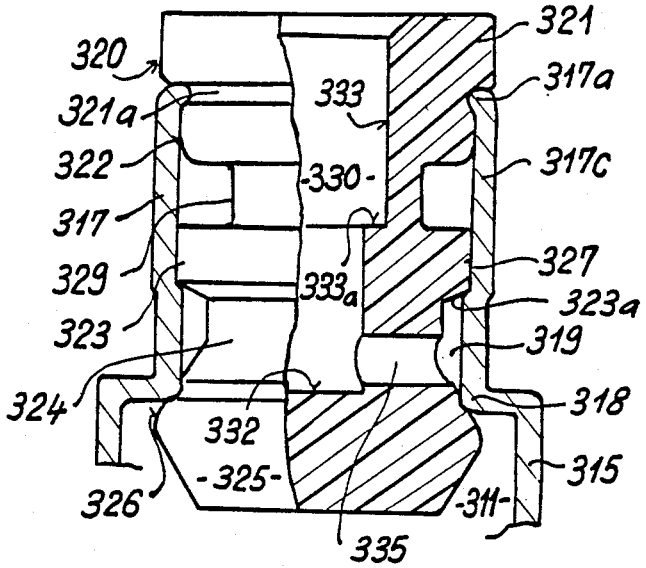

Fig. 9
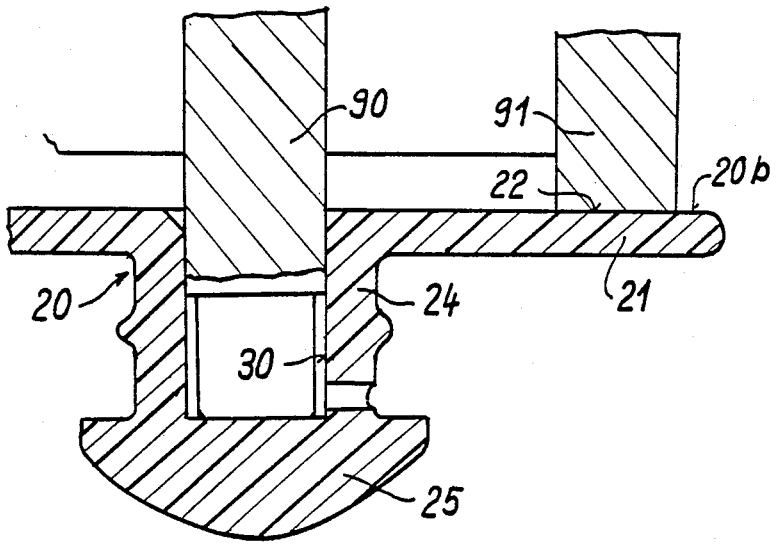
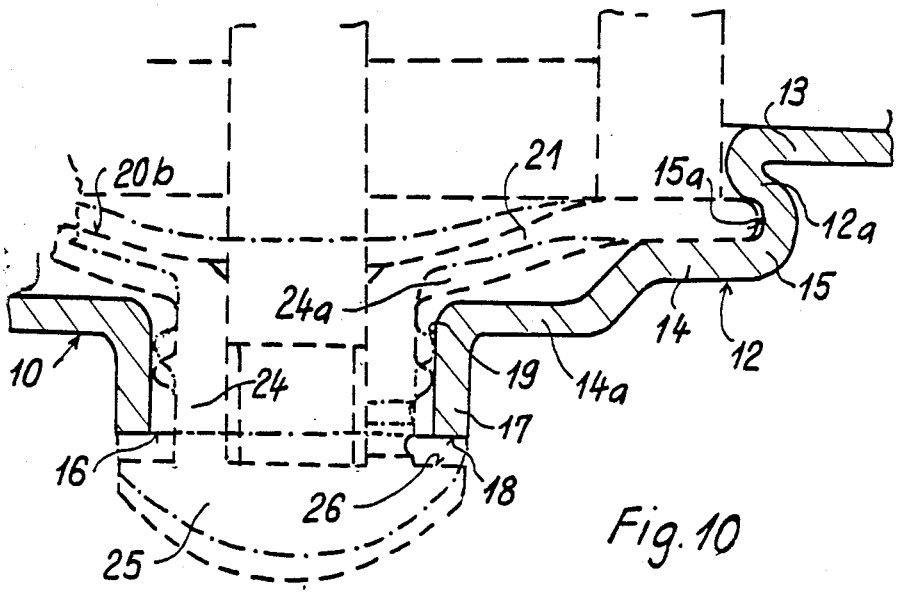
Fig. 10

XIII
XIII
-30-
-30-
-2-
CA
CA
LP
d1
d2
2a

PROCESS FOR PRODUCING A VALVE-AND-LID ASSEMBLY

RELATIONSHIP TO EARLIER APPLICATIONS

This application is a continuation-in-part of our earlier application Ser. No. 259,158 filed Aug. 30, 1981, now U.S. Pat. No. 4,442,959 granted Apr. 17, 1984, and the continuation-in-part thereof Ser. No. 347,321 filed Feb. 9, 1982, now U.S. Pat. No. 4,493,444.

This invention relates to a process for producing a valve-and-lid assembly comprising a valve body and a lid and having a central assembly axis and adapted for closing the open top end of a container, and preferably of a container which is fillable with pressurized product.

More particularly this process relates to producing a novel valve body, and a novel combination of steps of mounting the novel body in a lid, separately produced in finished condition.

The lid used in the process according to the invention can be of known or of novel structure. The lid, in finished condition, has a periphery which is adapted for being sealingly connected with a top rim of a container sidewall surrounding the container top opening, and extending generally transverse to the central assembly axis; the lid has a dome and a central opening in the middle of the dome and is rigid under conditions of filling product into, and discharging product from, the said container;

the lid preferably has a flat lid part and extends generally in a main lid plane transverse to the central assembly axis, and about the dome;

at least a portion of the dome is a collar portion comprising an annular rim or shoulder edge adapted for making sealing contact, about the central dome opening, with the valve body in a first annular contact zone of the latter.

In U.S. Pat. No. 3,144,179 to A. M. Gildone, there has already been described a valve-and-lid assembly in which a semi-finished lid is used in which the lid is shaped to achieve its finished condition after an equally unfinished valve body has been lodged in the same.

The unfinished valve body used to produce the Gildone-assembly comprises, as an annular portion which is elastically resiliently deformable under conditions of filling into, and discharging product from the container, a flexible diaphragm the periphery of which has the shape of an annular skirt. The diaphragm is attached as a flange to a tubulure which protrudes on the outer, upper face of the diaphragm and has a bottom opening in the center of the latter. A valve steam projects below the inner, lower face of the diaphragm and is connected to the latter by two circumferentially spaced webs. This valve body is placed centrally from the outer or inner side against a radially inwardly projecting crimp in the flat lid part about the central opening which crimp is surrounded downwardly or upwardly by an open sleeve portion of the lid which is then cold-shaped to form a cup or dome with a depending sleeve part having a narrower lower central inlet opening for product from which the lowermost end of the valve stem protrudes, while the last-mentioned valve stem end is heat-deformed to be shortened and widened to form a head, the upper, outwardly directed face of which is to be brought into sealing contact with the annular rim about the narrow bottom opening of the lid cup. The valve stem, the stem head and the cup are so dimensioned that the diaphragm normally urges the enlarged button into sealing engagement with the annular rim of the cup inlet opening.

In the finished valve body of the Gildone assembly, as mounted in the lid cup thereof, the tubulure of the valve body has an axially extending passageway or cavity which opens out of the diaphragm on the underside of the latter. When the diaphragm is pressed downwardly, e.g. by a spray head containing a spray nozzle and having a downwardly extending tubular shaft which is inserted in the tubulure of the valve body, the central valve stem is moved downwardly through pressure transferred to it via the two stays, and the annular contact face on the upper side of the stem head is moved downwardly out of contact with the annular rim about the narrow cup inlet opening. Thus, product from the interior of the container on which the Gildone-assembly is mounted can pass into the long neck portion of the lid cup and fill the entire cup space below the diaphragm, rise under the pressure in the passageway of the tubulure on the outside of the diaphragm and thus reach the spray nozzle from which it is expelled in a spray cloud.

This known lid-and-valve assembly suffers from a number of drawbacks. Thus, the process of assembling the lid and the valve body is very cumbersome; the cold-shaping of the lengthy sleeve portion about the stem of the valve body or the crimping of the cup bottom to enclose the diaphragm skirt, and the heat-molding of the button at the end of the valve stem makes it difficult to obtain a safe seal between the two parts at the inlet end of the lid cup sleeve; the flow of product along the inner wall of the lid cup sleeve and the center surface of the valve stem and the need to fill the entire lid cup before product can emerge will frequently cause residual product to remain in the cup after the valve button has closed the product inlet in the lid cup sleeve; transmission of depressing force from the upper tubulure to the lower valve stem via the two small webs can cause poor alignment with the central assembly axis; and, as the long valve stem is completely unguided in the lid cup sleeve during the closing phase the stem head may easily be seated out of alignment and permit penetration of air into the container spoiling the product therein.

Other lid-and-valve assemblies are known, in which however, the valve body is substantially rigid, so that special spring means have to be provided for permitting shift of the valve body to open position and cause automatic return of the valve body from open to closed position, as in the container valve of O. L. Ashton described in U.S. Pat. No. 2,696,934; or a rigid valve body is lodged in a resiliant portion of the lid, e.g. a rubber inset in the central lid opening of a tilting valve as described by George Diamond in French patent application Publication No. 2 354 260; or the lid does not act as a part of the valve at all, but merely as a valve mounting as is the case in the slot valves described by John Schmidt in U.S. Pat. Nos. 2,662,668 and 2,662,669 and by Angelo Bottani in French patent application Publication No. 2.048.915; finally, C. L. Alexander describes in U.S. Pat. No. 3,272,403 a slot valve in which the axially extending slots in a rubber valve body extend from the interior of the container to the outer side of the valve body in a region, resting in closed position, against the inner wall of the flat lid part surrounding the dome part of the lis, whereby upon opening of the lid product enters into and fills the space in the dome part above the valve body, involving the risk of having residual product in said space which can age therein and clog the passageway to the spray nozzle of the container.

It is, therefore, an object of the instant invention to provide a process for producing and assembling, more easily than in the case of the Gildone valve, a lid-and-valve assembly as initially described, which process is readily carried out with conventional tools and permits production of a novel valve-and-lid assembly free from the drawbacks of the known valves described hereinbefore.

This object and others that will become apparent during the further description of this invention hereinafter are attained in a process of the initially described kind which comprises (A) producing, in finished condition, a lid of the initially described type;

(B) producing separately, in finished condition, a valve body which comprises:

(a) at least one annular elastically resilient portion which is bendable toward, or stretchable in, axial direction, (b) a radially extending upper valve body portion having an outer surface adapted for facing away from the said container and an inner surface facing toward the interior of the container, (c) a valve stem centrally and axially protruding at least from a first one of the upper body portion surfaces and adapted for being lodged in the lid dome collar portion, (d) a valve head at an end of the valve stem remote from the said upper valve body portion and having a diameter transverse to the central assembly axis which is larger that the diameter of the valve stem and destined to be located outside, and when the assembly is in open position, forming a gap with, the said lid dome collar portion; the valve head bearing a first annular contact zone so located thereon as to face toward the collar portion and adapted for making sealing contact with a rim or shoulder of the latter, when the assembly is in closed position, (e) a cavity having an opening in the surface of the valve body facing away from the valve head and extending axially at least in the valve stem and having a bottom end located near the radial plane in which the first contact zone on the valve head extends, (f) additional annular sealing means about the valve stem spaced from the valve head and adapted for making sealing contact at all times with the lid dome collar portion in a second zone nearer the upper body portion of the valve body than the first contact zone, (g) and duct means one end of which opens in the cavity and the other end of which opens out of the valve stem in a region thereof extending between the first and short of the second contact zone;

(C) mounting the valve body on the mandrel of a piston movably associated with a pressure cylinder, and aligning the mandrel, on the side of the lid part facing away from the annular rim, with said central assembly axis through the central dome opening of the lid;

(D) striking the mandrel with sufficient force to drive the same with the valve body thereon abruptly through the collar portion of the lid dome and to pass the valve head out of said annular rim or shoulder edge, snapping said contact zone of said valve head free from misalignment of, or damage to, the latter, into sealing contact with said annular rim or shoulder edge from the outside of said lid dome collar portion, and (E) limiting the stroke of the piston which abruptly advances the mandrel into the lid dome collar portion to stop when the first annular contact zone on the valve head has passed to the outside of the rim or shoulder edge, thereby preventing permanent stretching of the valve stem.

In step B of the process according to the invention, the valve body can be produced with at least one annular region of the valve stem, intermediate the inner surface of the upper body portion of the valve body and the first annular contact zone, being axially stretchable.

In another mode of carrying out the process according to the invention in practice, the lid is produced, in accordance with step (A), so that the dome has a foot zone in which the dome merges with the flat lid part, and which zone is crimped to comprise an annular bead projecting radially inwardly toward the central assembly axis;

while, in step B, the upper body portion of the valve body is shaped as a flange of such diameter as to snapfit into the said crimped foot zone of the dome foot part; and, in step C, the mandrel is surrounded by an annular skirt adapted for abutting against the peripheral region of the outer surface of the flange-shaped upper body portion inside the circumference of the annular bead of the dome foot zone, and, in step D, the adjacent peripheral region of the flange-shaped upper body portion is caused to snap into position in the crimped foot zone between the annular bead thereof and an adjacent portion of the dome sidewall.

Preferably in steps C and D, the mandrel which protrudes into the valve body cavity from the outer valve body surface, has a flat-nosed tip which rests against the cavity bottom during the introduction of the valve body into the collar portion of the lid dome.

The diameter of the upper body portion is preferably such that the peripheral zone of the inner surface thereof is approximately equal with, or slightly larger than, an underlying radially extending rim portion of the lid dome.

The thrust of the mandrel corresponds to a force of at least 2 to 3 kilopond applied to the frontal face of the piston turned away from the mandrel. Uniform results are particularly obtained with a force of 4 to 8 kilopond applied to the mandrel.

In valve-and-lid assemblies of the usual sizes for use on pressurized spray cans, the work path corresponding to the length of the collar portion offering resistance to the passage of the valve head therethrough can range from 0.5 to 5 millimeters.

The lid is conventionally produced, e.g. from a metal of the aluminum type, while the valve body is preferably produced from an elastomeric synthetic resin the physical properties of which are similar to those of Hytrel; however, in certain embodiments according to the invention, the valve body can also be produced from various types of rubber.

A "valve-and-lid assembly" as referred to in this application means a valve in which a portion of the lid serves as the valve seat, with which a valve body is in sealing contact, while the valve is closed, but with which it is at least partially out of contact when the valve is open, as is the case, e.g. in the devices described in U.S. Pat. No. 3,144,179 to A. M. Gildone, described supra, and, although only to a limited extent, in U.S. Pat. No. 3,272,403 to C. L. Alexander.

The use of a portion of the lid as a housing for a valve part which is fixedly lodged therein is well-known in the art; this kind of arrangement is not intended to be covered by the above-cited term in the instant application.

In C. L. Alexander's valve, the lid is also not really needed as a "sealing" valve seat, as the slot valve body is self-sealing, the lid dome serving more as a housing.

Preferably, the valve body consists of a synethetic resin material selected from the group consisting of a polyester elastomer of the Hytrel 4055 type and an ethylene-vinyl acetate copolymer resin of the Elvax 3120 type.

Elvax 3120 is an ethylene-vinyl acetate copolymer resin made by E. I. Dupont de Nemours, Wilmington, Del., it contains 7.5 weight-% of vinyl acetate units and has a density of 0.93 g/cm$^3$ and a melt index of 1.2 g/10 min (ASTM D-1238), while the even more preferred polyester elastomer Hytrel 4055, which is also made by Dupont, has a melting point of 168° C., a softening point of 112° C., a density of 1.17 and a tensile strength of 415 kg/cm$^2$. Further details about these substances can be found in pamphlets of the above-mentioned American company.

Further objects and details of the invention will become apparent from the following description of preferred embodiments of the same illustrated in the accompanying drawings in which FIG. 1 illustrates the stages of a preferred mode of carrying out the process according to the invention in practice, with production of a first embodiment of the finished valve-and-lid assembly shown in axial view;

FIG. 3 shows a partial lateral view, cut away on the right-hand side to show an axial sectional view, of another embodiment of the valve body used for mounting in a lid by way of the process according to the invention;

FIG. 4 is a similar view of yet another embodiment of the said valve body;

Figures 5, 6:
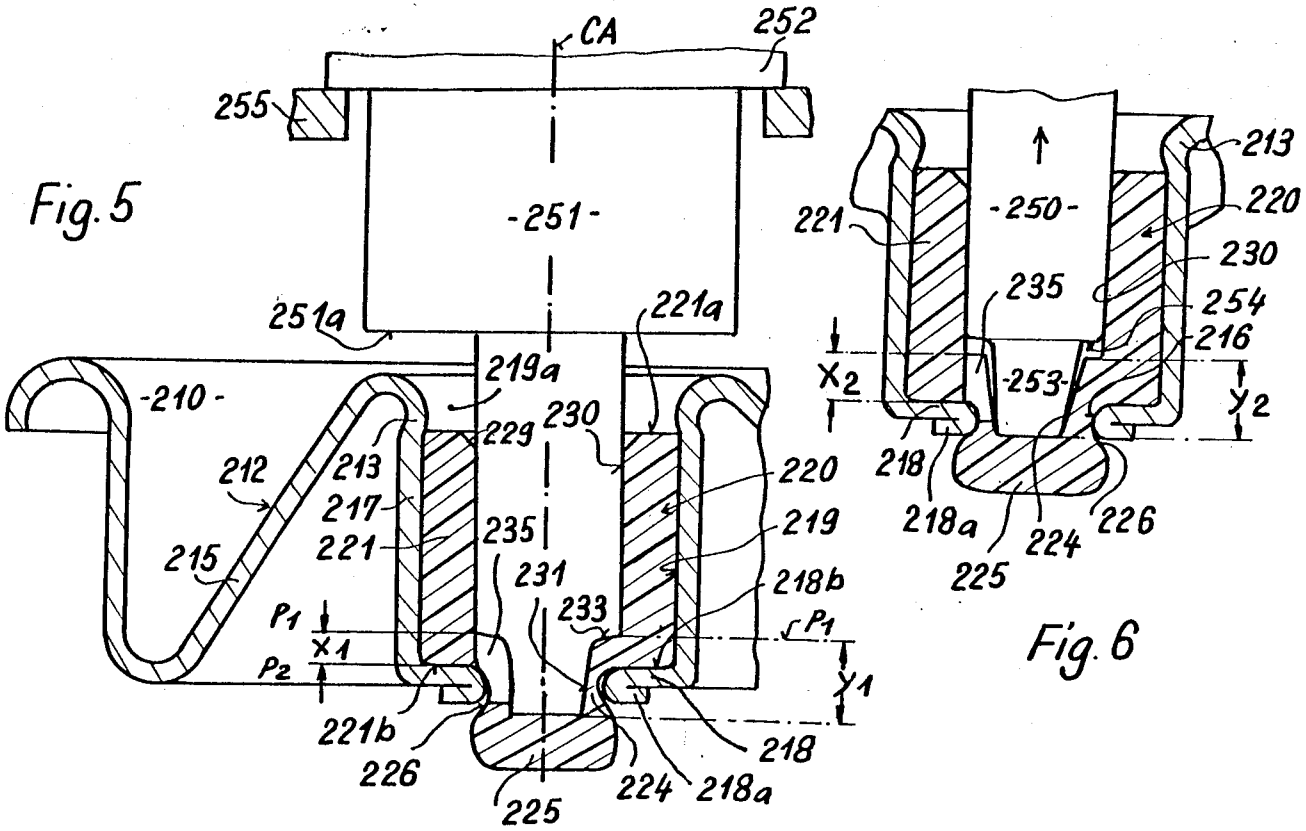
Figure 7:
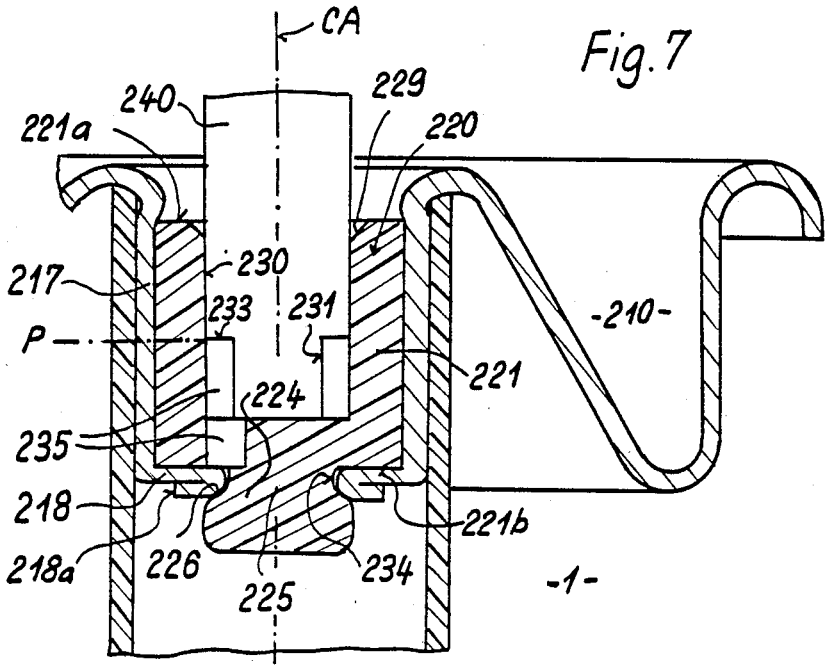
Figure 8:
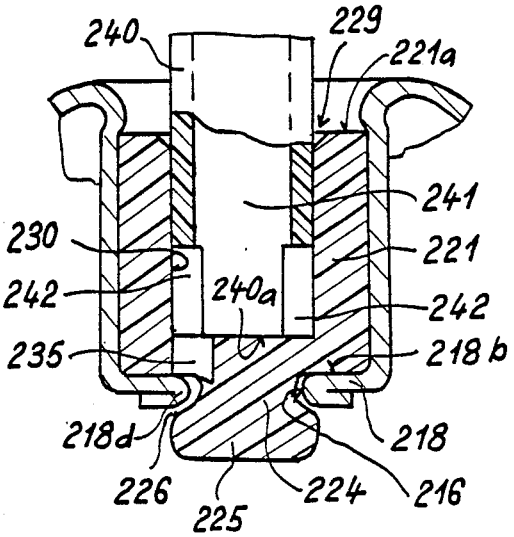

FIGS. 5 and 6 show in axial sectional view two phases of mounting a novel valve-body of a different type in a lid of somewhat different construction, in accordance with the process according to the invention, FIGS. 7 and 8 show the resulting assembly equipped with an actuating member, in the closed and in the open position, respectively, and FIG. 9 shows a final phase of assembling a further embodiment, described in Irish patent application No. 1643/81 (114/120) and in parent application Ser. No. 347,321 filed Feb. 9, 1982, now U.S. Pat. No. 4,493,444 with the aid of the process according to the invention. FIG. 10 shows the completed assembly obtained by the process illustrated in FIG. 9.

The process steps for manufacturing the valve-and-lid assembly shown in FIG. 1 comprise the steps of producing a finished lid 10, in a first stage, and, separately therefrom, producing the finished valve body 20.

The valve body 20 is then placed on the mandrel 50 which protrudes downwardly from a piston rod 51 which is rigidly connected to the rear face of a piston (not shown) lodged for downward displacement in a pressure cylinder (not shown) and activated in the latter, e.g. by compressed air applied to the front face of the piston, or by other media or mechanical means.

The mandrel 50 with the valve body 20 in position thereon is then aligned with the lid 10 along a common central axis CA.

The lid 10 which is destined to close the top opening 2 of a can or the like container has a peripheral crimped zone 10*a* by means of which it can be connected to the rim 3 of the can 1.

The lid 10 further comprises a dome 12 which merges in a foot zone 12*a* with a flat lid part 13 which generally extends in a main lid plane LP which is radial to the central axis CA. In the embodiment of the lid 10 shown in FIG. 1 the dome 12 protrudes upwardly from the flat lid part 13, i.e., away from the can interior. In other lids which are equally usable in the process according to the invention, the dome 12 can protrude downwardly, i.e. toward the container interior, from the flat lid part 13.

The dome 12 has a top wall 14 and a circumferential sidewall 15, as well as a central opening 16 in the top wall 14 about the central axis CA.

The central opening 16*b* is surrounded by an axially extending collar portion 17 of the dome 12, which protrudes upwardly from the dome top wall 14. This collar portion 17 which plays an important function in carrying out the process of the invention, could likewise protrude downwardly from the dome top wall 14.

An annular shoulder 18 is formed between the lower end of collar portion 17 where it merges with the top wall 14 of the dome 12. In the embodiment of FIG. 1 the collar portion 17 is flared upwardly and outwardly and surrounds a passageway 19 of frustoconical configuration, the diameter of which at its upper, outer end 19*a* is larger than that of the central opening 16*b*. The annular rim 17*a* of the collar portion 17 about the upper open end 19*a* of passageway 19 is preferably crimped or slightly beveled to facilitate the entry of the valve body 20 into the passageway 19.

The valve body 20 is produced, preferably from an elastomeric material such as Hytrel or another polymeric synthetic resin of similar properties, by injection molding techniques.

It comprises a preferably flange-shaped upper, outer portion 21 which bears on its lower face, which is turned inwardly, i.e. toward the interior of a container which is to be covered by the valve-and-lid assemby, a frusto-conical dowel or jack part 22 and at the frontal face 22*a* of the latter a reduced diameter valve stem 24 which bears at its free end a valve head 25 of enlarged radial diameter which must be larger than the width of the central opening 16 in the top wall 14 of the dome 12, so that the valve head has a rearward annular face 26 turned toward the dowel part 22,which face can extend in a radial plane or, preferably, as in the embodiment shown in FIG. 1, is conically tapered, this face 26 abutting sealingly in a contact zone 26*a* against the annular shoulder 18 closing the central opening 16, when the parts of the assembly are in closed position.

While, in the embodiments of this valve body shown in our earlier European Pat. Appln. No. 81105298.4 and in parent application Ser. No. 347,321 filed Feb. 9, 1982, now U.S. Pat. No. 4,493,444 this rearward annular face 26 of the valve head (or valve head button) 25 generally extends in a plane perpendicular to the central assembly axis CA, it has now been found that the sealing effect thus achieved is most satisfactory when the face 26 is tapered, and the angle enclosed between the tapered face 26 and the central axis is less than 45°, and preferably about 25° to 40° (angle d in FIG. 1).

Corresponding to the slope of the frusto-conical part 22 of the valve body 20, the flared collar portion 17 of the lid dome 12 has the same angle of inclination with the central axis. The length of the dowel part 22 plus the stem 24 of the valve body 20 must be shorter than the distance, taken along the central axis CA, between the plane in which the upper annular collar portion rim 17*a* extends and the plane in which the edge of the annular shoulder 18 is located.

It has been found, that, in mass production, it would not be satisfactory to place the valve body 20 loosely into the passageway 19 of the collar portion 17 and than to apply pressure to the upper frontal face 21*a* of the body flange portion 21, This would lead to deformation of the valve head 26 and also possibly to bending of the valve stem 24; for, due to its reduced diameter the valve stem 24 is much more readily deformable, than is the remainder of the valve body 20. This applies specifically to FIG. 1.

In order to provide a passageway for product under pressure stored in a container which is to be closed by means of the valve-and-lid assembly according to the invention, the valve body 20 is provided with an axially extending cavity 30 which has an open top end 30*b* and a closed bottom 32. A duct or orifice 35 extends from a zone of the cavity 30 near its bottom 32 to the outer side of the valve stem 24; the duct end 35*a* through which the duct 35 opens to the outside is located preferably in the outer valve stem wall in the vicinity of the rearward annular valve head face 26, or in the latter, but above the contact zone 26*a*. When using a pressurized container equipped with such a valve, the shaft of a spray head containing a spray nozzle, or of another suitable actuating member can be inserted into the cavity 30, as has been illustrated in FIGS. 10 and 13 of the above mentioned earlier Irish Patent Application No. 1643/81 and in parent application Ser. No. 347,321 filed Feb. 9, 1982, now U.S. Pat. No. 4,493,444.

Operation when using the valve-and-lid assembly as illustrated in FIG. 1 as closure for a pressurized container requires insertion of the shaft of a spray head into the cavity 30, with the O-ring projections 34 sealingly engaging the shaft. When the spray head is actuated by depressing it, for instance, with the index finger of the hand holding the container, the shaft which must be long enough to abut against the bottom 32 of the cavity 30 will move this bottom downwardly while stretching the relatively thin wall of the valve stem 24. Thereby, the valve head 25 is also moved downwardly a short way, whereby the tapered annular face 26 of the valve head 25 is urged away from the annular shoulder 18 of the lid dome 12 and product can pass through the resulting annular gap upward into the passageway 19 and through the duct 35 into a passage provided in the above-mentioned spray head shaft via an opening in the sidewall of the shaft registering with the duct 35.

In order to reduce the volume inside the cavity 30 about such spray head shaft, into which product can penetrate during a discharge thereof, sealing means 34, e.g., in the shape of O-rings which are integral with the valve body 20, can be provided in the internal cavity wall 30*a*.

Likewise, in order to reduce in passageway 19 the space into which product from the container can penetrate when the valve opens, which space is located between the inner wall 17*b* of the collar portion 17 and the outer surface of the valve stem 24, and in which residual product is liably to remain after a discharge has stopped, second annular sealing means 23, preferably in the form of external O-rings molded integral with the dowel part 22 project from the latter and are in sealing engagement with the inner wall 17*b* when the valve body 20 is fully introduced into the lid dome 12.

During the assembling phase, these sealing means 23 help to guide the valve body as it is advanced into the passageway 19 of the lid dome collar portion 17.

As mentioned hereinbefore, it has been found that the introduction of the valve body 20 into the lid dome 12 must not be carried out slowly, regardless of the pressure applied in its cylinder on the piston 51 bearing the mandrel 50 which carries the valve body 20, if a significant proportion of waste due to misalignement of the valve body 20 in the lid dome 12 and corresponding danger of leakage at the contact zone 26*a* is to be avoided. Rather, it is necessary to apply the pressure suddenly, and not gradually, so that the valve body 20 and especially the stem 24 and the valve head 25 have no time to become misaligned and so that the valve head 25 will be snapped into position with its rearward face 26 resting against the annular shoulder 18.

The sudden advance at full speed of the mandrel 50 and the valve body 20 thereon into the collar portion 17 of the lid dome 12 can be brought about in various ways known per se, for instance by suddenly applying the full pressure from a source of compressed air to the frontal face of the piston in the above-mentioned pressure cylinder, or by equivalent thrust-producing means.

For example, if a cylinder and piston are used in which the piston stroke is 50 mm and the diameter of the frontal face of the piston having a circular cross section is 20 mm, and the length through which the valve head 25 must be moved against the resistance of the lower region of the sidewall 17*b*, and of the annular shoulder 26, is about 5 mm (based on an overall height of the dome 12, including the collar portion 17 thereon, of 10 mm), it has been found that the valve body 20 can be struck into position with a gauge pressure of compressed air of at least about 2 to 2,5 bar, but safe positioning avoiding waste is achieved with a compressed-air gauge pressure of about 5 to 8 bar. This corresponds approximately to a force of 15 to 25 kiloponds, instantaneously applied, regardless of the manner in which this force is generated.

During the introductory phase of the valve body 20 into the dome part 12, the flange of the upper valve body portion 21 comes to rest with its underside 21*a* upon the crimped upper rim 17*a* of the collar portion 17; however, the stem 24 must be stretched to push the valve head 25 out of the central opening 16 and a short distance below the annular shoulder 18 of the dome top wall 14. This means that the overall axial length $D_1$ of the valve body 20, which it has when in fully relaxed condition in which it is to be found, free from stress, on the mandrel 50 prior to introduction into the lid dome part 12, must be increased to the axial length $D_3$ which it has in the position indicated by a dashed line in the lower half of FIG. 1. In order to permit the mandrel 50 to enter into this position without compressing the flange of upper valve portion 21 and without suffering a slowdown due to such compression, the mandrel 50 is somewhat longer than the cavity 30 of the valve body 20 is deep, thus leaving a corresponding play $D_3$-$D_1$ and preferably a slight excess thereover, between the upper end face of upper body portion 21 and the underside 51*a* of the piston rod 51. This play d must, therefore, be slightly larger than ($D_3$-$D_1$).

The mandrel 50 is then withdrawn thanks to lifting off the piston in the above mentioned pressure cylinder, and as the tip of the mandrel 50 lifts off the bottom 32 of the valve body cavity 30, the stretched stem 24 can contract until the rearward annular face 26 of the valve head 25 abuts in the contact zone 26*a* against the lid dome shoulder 18. In this position the overall length of the still stretched valve body is $D_2$, i.e., slightly less than $D_3$, but larger than $D_1$, so that the valve head 25 makes contact with sealing bias, with the shoulder 18.

In order to ensure that the mandrel 50 does not travel too deeply into the passageway 19 which might cause excessive stretching of the valve stem 24 with permanent deformation and with rupture and/or deformation of the valve head 25, stop means schematically indicated at 55 are provided to arrest the advance movement of the mandrel 50. These stop means are preferably provided at the cylinder and arrest the piston or piston rod driving the mandrel 50 rather than the latter.

A riser tube 9 can be fitted firmly into the recess surrounded by the dome sidewall 15. The completed assembly consisting of the lid 10 and the valve body 20 inserted thereinto as well as the equally inserted riser tube 9 can then be delivered to a filling station where it is mounted in the opening of a container which is then filled with a product and a conventional propellant which can be a liquefied gas or an insert unliquefied gas under pressure.

Figure 2:
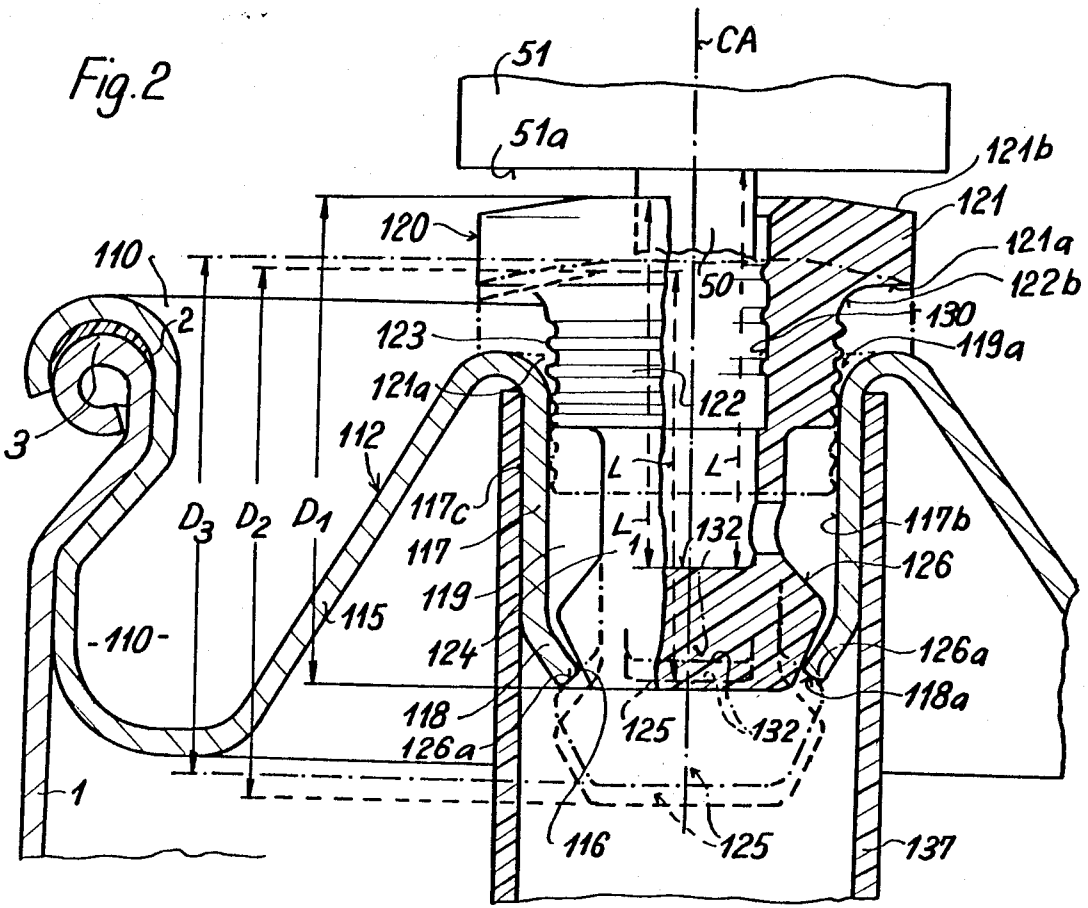
FIG. 2 illustrates in sectional view another embodiment of a valve-and-lid assembly produced in a similar manner.

In producing the embodiment of a valve-and-lid assembly according to the invention illustrated in FIG. 2 there are a number of features to be noted which are different from those present in the embodiment shown in FIG. 1. Thus, in the lid 110, the collar portion 117 of the dome 112 extends downwardly along the central axis CA and has a generally cylindrical configuration.

While the passageway 119 extends through the collar portion 117 essentially in the same manner as in FIG. 1, it has a top open end 119*a* at the zone 117*a* in which the sidewall 115 of the dome 112 merges with the collar portion 117, while the lower open end of the collar portion 117 constitutes the central opening 116. This central opening 116 is formed by punching out a large central portion of the originally closed end of the collar portion 117 which leaves an inwardly and downwardly curved annular rim portion 118 the edge of which cooperates sealingly with the contact zone 126*a* of the valve head 125 of the valve body 120. The latter only differs from the embodiment thereof shown in FIG. 1 by having a dowel part 122 which is of cylindrical rather than frusto-conical configuration. This dowel part 122 can also bear, integrally therewith, sealing O-rings 123 for sealing engagement with the inner wall 117*b* of dome collar portion 117. Moreover, the upper frontal face 121*b* of the flanged upper or base valve body portion 121 is slightly conically tapered from the central axis downwardly instead of being flat. Thanks to this feature and to the fact that the work-path along which the valve head 125 must travel against the resistance of the curved rim portion 118 until it snaps downwardly out of the opening 116 is very short in this embodiment, there is no need, in this case, to leave an excess play d between the upper frontal face 121*b* and the underside 51*a* of the piston rod 51.

In the process of manufacturing this embodiment, the valve body 120 can be loosely inserted into the open end 119*a* of the collar portion 117 of the lid 110 which is already mounted in place by crimping the lid rim over the rim 3 of the can 1. The valve body 120 then takes up a position as shown fully drawn in FIG. 2. Its length is then $D_1$.

The piston rod 51 bearing the mandrel 50 on its frontal face 51*a* then strikes the valve body 120, with the mandrel 50 penetrating into the cavity 130 and, as the length L of the mandrel is preferably as great as, or greater than the depth of the cavity $L_1$ when the valve body 120 is free from axial stress, the tip of the mandrel strikes the bottom 132 of the cavity 130 shortly before the underside 51*a* of the piston rod 51 hits upon the upper frontal face 121*b* of the flanged valve body portion 121.

The valve stem 124 is then stretched similar to the same phase in assembling the embodiment of FIG. 1, so that the entire length of the valve body is extended to $D_2$ and the valve head 125 is snapped out of the central opening 116 and assumes the position indicated in dashed lines in FIG. 2, whereupon the piston rod 51 and mandrel 50 are immediately withdrawn and the valve body 120 automatically assumes the position shown in phantom lines in FIG. 2 in which position the valve head 125 has the length $D_3$ and is thus still longer than $D_1$ and, therefore, still slightly stretched. Due to this stretching, the rearward annular face 126 of the valve head is urged with bias into sealing contact with the outer rounded rim 118*a* of the collar rim portion 118.

The diameter of the O-rings 123 which are integral with the dowel part 122 is slightly larger than the inner width of cylindrical passageway 119 so that they engage the inner wall 117*b* with slight sealing friction. This radial pressure of the O-rings against the inner wall 117*b* is however sufficiently large to provide a liquid- and gas-tight seal. Moreover, the foot zone 122*b* of the dowel part 122 is flared outwardly and upwardly to merge with the underside 121*a* of the flanged valve body portion 121. Stretching forces transmitted from the valve stem 124 upwardly through the dowel part 122 into the flanged valve body portion 121 thus cause the O-rings 123 to be pulled radially into stronger sealing contact with the inner surface 117*b* of the collar portion 117 as the valve head 125 is pulled upward against the rim 118*a* of the collar rim portion 118.

Before the advance of the piston rod 51 and together therewith that of the mandrel 50 stops, this advance can be lightly cushioned by the central apex portion of the valve body 120. The remainder of the operation of assembling the valve body 120 and the lid 110 is largely identical with that of assembling the embodiment of FIG. 1.

A riser tube 137 can be conveniently and firmly attached to the outer wall 117*c* of the lid dome collar portion 117.

Figure 2A:
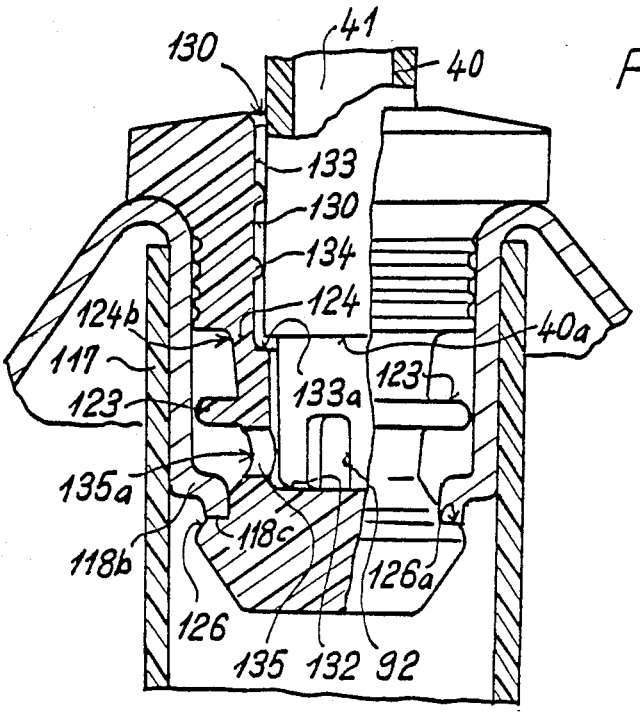
FIGS. 2A and 2B, show in sectional views, variations of details of the assembly shown in FIG. 2.
Figure 2B:
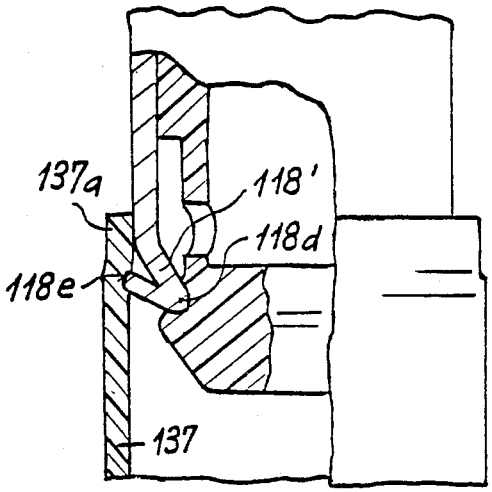

In the FIGS. 2A and 2B, there are shown variations of the annular rim portion 118 at the lower end of collar portion 117. In FIG. 2A the collar portion 117 bears at its lower end a narrow inwardly projecting bottom flange 118*b* and about the inner periphery of the latter a downwardly bent annular edge 118*c* which penetrates sealingly, in the contact zone 126*a*, into the rearwardly tapered valve head surface 126. In FIG. 2B, the curved rim portion 118' is distinguished from the rim portion 118 shown in FIG. 2 by having a crimped edge 118*d* instead of the straight rounded edge of the rim portion 118 of FIG. 2.

In FIG. 2A, there is shown the shaft 40 of a spray head (not shown) containing a spray nozzle (not shown) inserted in the cavity 130, instead of the mandrel 50. This shaft 40 has an axial longitudinal duct 41 leading to the spray nozzle and, at its lower end, a port or window 92 through which the duct 135 through the wall of stem part 124 is in communication with the interior of the duct 41. The shaft 40 is engaged sealingly by O-rings 134 which are integral with the wall 133 of the cavity 130. A shoulder 40*a* of the shaft 40 can rest on an annular shoulder 133*a* in the cavity 130 axially spaced above the cavity bottom 132. Opening of the valve is then effected by stretching the stem wall zone 124*b* and moving the head 125 out of contact with the rim 118*c*. The lower end portion of the shaft 40 containing the window 92 is then not required. In order to reduce the size of the dead volume between the inner wall of the collar portion 117 and the outer surface of the valve stem 124, a guiding and sealing disc of flange 123 is provided integral with the valve stem 124 and preferably in sealing engagement with the inner wall 117*c* of collar portion 117 a short distance above the external entry opening 135*a* of the duct 135.

In the embodiment of FIGS. 2, 2A and 2B the outer portion of the dome 112 as well as the collar portion 117 thereof can each be of approximately the same height as the outer peripheral wall of the lid 110, while in the embodiment shown in FIG. 1 the lower portion of the dome 12, surrounded by the dome sidewall 15, and the collar portion 17 together must not be higher than the peripheral sidewall of lid 10, which is always desirable, for reasons of keeping the dimensions of the processing machinery as small as possible. There is thus more axial space available in the interior of the collar portion 117 (FIG. 2) than in the collar portion 17 if both lids 110 and 10 are of equal height.

In the embodiment of the valve body 20 shown in FIG. 3, the stem portion 24 bears on its outer wall a helical bead 27 which does not engage the inner wall of the dome part 17. Rather, it extends the life of the stretchable portion of the valve body 20, i.e., the valve stem 24. Due to its helical form the bead 27 also imparts a slight torsion to the valve stem 24 when the latter is stretched, be it by a downwardly moving mandrel 50 or by a depressed spray head shaft 40. Instead of a helical bead 27, there could also be provided a number of parallel annular radial beads protruding from the outer surface of the valve stem 24. Both, the last mentioned annular beads, or the helical bead 27, can be produced integral with the valve stem 24 by injection molding.

The embodiment of a valve body 320 shown in FIG. 4 consists of a flanged upper body portion 321, an upper dowel portion 322 having at its foot zone where it merges with the upper portion 321 a circumferential groove 321*a*, which upper dowel portion 322 is connected, in axially downward direction, via a reduced diameter dowel section 329 with a lower dowel portion 323, the underside 323*a* of which bears a very short valve neck 324 which is preferably thicker than the reduced diameter dowel section d29, and finally the valve head 325. In this valve neck 324, there is provided the entry duct 335 for product flow, when the valve is open.

The product passage from the lower dome part interior recess 311 upwardly into the entry duct 335 and into the cavity 330 is obturated by the rearward conical face 326 of the valve head 325 being urged with bias against the annular shoulder 318 between the lower dome part sidewall 315 and the collar portion 317. The lower dowel portion 323 bears on its peripheral sidewalls integrally molded sealing beads 327 which engage the internal wall 317*c* of the collar portion 317 in a liquid- and gas-tight manner.

This embodiment of the valve body has the advantage of having no dead space for residual product between the entry duct 335 and the internal wall 317*c* exept the very small space 319 above the rearward conical face 326. Axial downward displacement of the valve head 325 during opening of the valve is made possible by the reduced diameter section 329 between the dowel portions 322 and 323, being stretched.

The bias of the valve head 325 against the shoulder 318 is secured by a slightly inwardly curved annular rim portion 317*a* which engages the circumferential groove 321*a* between the upper valve body portion 321 and the upper dowel portion 322 of the valve body 320.

Assembly of the valve body 320 in the lid collar portion 317 can be carried out in a similar manner as in the embodiments illustrated in FIG. 2.

Actuation of the embodiment of a valve-and-lid assembly as shown in FIG. 4 can be carried out with use of an actuating member such as the spray head shaft 40 shown in FIG. 2A. The downward deformation by stretching of the reduced diameter section 329 can be effected by the lower end face 40*a* of the shaft 40 engaging either the bottom 332 or a shoulder 333*a* in the inner sidewall 333 of the cavity 330.

This embodiment is recommended especially for use with products which are liable to attack the material of the valve body and alter its elasticity. In the embodiment shown in FIG. 4, such product will not come into contact with the elastically stretchable reduced diameter portion 329, owing to the sealing beads 327.

In FIGS. 5, 6, 7 and 8, there is shown a further embodiment of the valve-and-lid assembly according to the invention in which the lid 210 is of a construction very similar to that of FIG. 2B, while the valve body 220 is made of softer elastically resilient material having, for instance, a Shore hardness A of 70, while the earlier described valve bodies are made of a synthetic polymeric material having a Shore hardness A of 78 to 80.

The valve body 220 is of simpler configuration than the valve bodies of the preceding embodiments. It consists of a preferably cylindrical main body 221, a valve head 225 and a short narrower-diameter valve neck 224 connecting the valve head 225 with the valve main body 221. A central axial cavity 230 extends from an opening 229 in the flat top end face 221*a* downward to a radial plane $P_1$ above that ($P_2$) of the lower end face 221*b* of the valve main body 221, from which plane $P_1$ a narrower diameter extension 231 of the cavity ends in the neck 224 or the head 225. At the lower end of the cavity 230 where the reduced diameter extension 231 begins, an annular internal shoulder 233 is formed between the two regions of the cavity 230, in which shoulder a window 235 permits free communication between the interior of the cavity 230 and the outside. This window is closed, in the valve-and-lid assembly, by the radially inwardly projecting annular bottom flange 218, the inner rim of which about the central opening 216 is preferably rounded off by a downwardly and outwardly crimped rim portion 218*a*.

During manufacture, the valve body 220 and the lid 210 are assembled essentially in the same manner in which assembling is effected in the case of the embodiment of FIG. 1.

The valve body 220 is mounted on a mandrel 250 protruding from the frontal face 251*a* of a piston rod 251, which mandrel 250 has at its tip a reduced diameter nose part 253 forming an annular shoulder 254 on the frontal face of the mandrel 250 (FIG. 6).

The overall length of the mandrel 250 inclusive of its nose part 253 must be considerably greater than the total depth of the cavity 230 inclusive of its extension 231.

The collar portion 217 of the lid 210 bears at its upper end 219*a* where it merges with the upper end of the dome sidewall 215, a radially outwardly extending annular indentation 213. When the mandrel 250 strikes downward into the internal passageway 219 of dome collar portion 217, carrying the valve body 220 with it, it reaches the position shown in FIG. 5 in which the downward stroke of the mandrel 250 is stopped, for instance, by an annular stop flange 252 on the piston rod 251 abutting against stop means 255. In this position, the lower end face 221*b* of the main body 221 has struck the upper face 218*b* of the annular bottom flange 218, and the mandrel nose 253 has stretched the valve neck 224 sufficiently to open a gap between the rearward tapered face 226 of the valve head 225 and the underside of the crimped rim portion 118*a* of the bottom flange 218. At the same time, the shoulder 254 formed on the frontal face of the mandrel 250 by its projecting nose part 253 compresses the portion of the main body 221 between the internal shoulder 233 and the frontal face 221*b* resting on the upper face 218*b* of the lid bottom flange 218.

As the mandrel 250 and its nose part 252 are withdrawn from the cavity 230 of the valve body 220, the valve neck 224 contracts and moves the rearward face 226 of the valve head 225 into sealing contact with the rounded rim of the crimped flange 218 about the central opening 216. Thereby, the entry duct 235 in the main body 221 is fully obturated, the neck 224 is less stretched than in the position shown in FIG. 5, although it is still stretched compared with a completely relaxed condition of the valve body 220, in which condition the latter is found when mounted on the mandrel 250 prior to introduction into the lid dome collar portion 217. At the same time, the compressed lower portion of the main body 221 is also relieved of pressure by withdrawel of the mandrel shoulder 254 and thus exerts an upward pull on the valve neck 224 and valve body 225, increasing the sealing effect of the latter parts against the crimped rim about the cetral opening 216, while at the same time increasing upward pressure of the periphery of the top end face 221*a* of valve body 221 against the annular indentation 213 at the upper end of the lid dome collar portion 217.

In FIGS. 7 and 8, a similar embodiment as shown in FIG. 6 is illustrated, but with the mandrel 250 fully withdrawn and replaced by the shaft 240 of a spray head (not shown) containing a spray nozzle (not shown). The spray head shaft 240 contains a duct 241 which opens through windows 242 at the shaft bottom end. The entry duct 235 extends sufficiently radially into the valve neck 224 and the lower portion of the main body 221 to ensure free communication between the duct 235 and the interior duct 241 of the shaft 240.

In the closed position illustrated in FIG. 7 the rearward face 226 of the valve head 225 is in sealing contact with the crimped rim 218*d* of the bottom flange 218 of the collar portion 127.

When the shaft 240 is depressed, it compresses the lower portion of the main valve body 221 between the downward shaft end 240*a* and the upper face 218*b* of the bottom flange 218, thereby urging the valve neck 224 and the valve head 225 thereon downwardly, and thereby moving the rearward valve head face 226 out of contact with the crimped rim 218*d* of the bottom flange 218, thus opening the path for pressurized product to flow from a container on which the valve-and-lid assembly is mounted into the entry duct 235 to the axial duct 241 in the shaft 240 and outward into the spray nozzle connected therewith.

The embodiment of a lid-and-valve assembly illustrated in FIG. 9 has already been described in the earlier Irish Pat. Application No. 1643/81 and is illustrated in the assembled state in FIGS. 1 and 2 thereof and in parent application Ser. No. 347,321 filed Feb. 9, 1982, now U.S. Pat. No. 4,493,444. FIG. 9 illustrates in its upper part the valve body 20 mounted on a mandrel 90 which is surrounded by an annular pressure element 91. Both are actuated by a piston rod (not shown) and can be integral with each other.

The annular pressure element 91 rests with its underside on a corresponding annular surface area 22 of the upper face 20*b* of a valve disc 21 constituting an annular, radially outwardly extending flange about the valve stem 24. In the lower part of FIG. 9 there is shown the lid 10 comprising a peripheral crimped zone by means of which the lid 10 is or can be fastened to a container.

The lid 10 comprises an annular flat lid part 13 from which there projects downwardly the dome 12 which has an inwardly crimped foot zone 12*a* and a top wall 14 which merges with the foot zone 12*a* by means of an outwardly crimped sidewall 15 forming therein an annular recess 15*a*. About the central opening 16, the dome top wall 14 bears a short collar portion 17, which protrudes from a downwardly vaulted annular zone 14*a* of the top wall 14.

When the mandrel strikes downward, it carries the valve body 20 into the passageway 19 within the collar portion 17 and presses the valve head 25 out of the central opening 16 and a short way below the annular shoulder 18 at the lower end of the rim portion 17. This position of the valve body 20 is indicated in the lower half of FIG. 1 by dashed lines. As the mandrel 90 and annular pressure element 91 pass upwardly from this position shown in phantom lines, the disc portion 21 has snapped radially downwardly and entered the annular recess 15*a*, while the more strongly bent region 24*a* thereof, in which the disc portion 21 merges with the neck portion 24 becomes less bent an pulls the valve head 25 upwardly with the rearward face 26 of the latter into sealing contact with the shoulder 18 of the collar portion 17. This position of the valve body 20 is indicated by dashed lines in the lower part of FIG. 9. Meanwhile, the mandrel 90 and the annular pressure element 91 will have been fully withdrawn from the valve-and-lid assembly which is now in closed condition, and a spray head shaft 40 can be inserted either in the manner shown in FIG. 1 of European Pat. Appln. No. 81105298.4 and in parent application Ser. No. 347,321 filed Feb. 9, 1982, now U.S. Pat. No. 4,493,444 or in the manner shown in the preceding FIGS. 2A, 7 and 8. The former mode of mounting the spray head shaft 40 on the valve body 20 is satisfactory in the embodiment shown in FIG. 9, because opening of the valve is effected more by a downward bending of the central valve disc zone about the cavity 30, for which there is room thanks to the downwardly vaulted dome top wall portion 14*a*, than by a stretching less flexible valve neck 24.

As memtioned before, the valve head 25, which has a radially extending flat rearward face 26 in the embodiment shown in FIG. 9, is preferably provided with a steeply tapered rearward face 26. Such rearward tapering, when at an angle $\alpha$ of less than 45° also provides for a better self-centering of the valve head on the valve seat constituted by the shoulder 18 of the collar portion 17. Of course, an annular pressure element 61 can also be used together with the mandrel 50 in position in the embodiment of FIG. 1, in order to assist in pushing the frustoconical dowel part 22 into its final position in the collar portion 17.

When the neck portion 24 is stiff enough to transmit a striking force applied to the upper valve body face 20*b* in the zone about the opening therein of the cavity 30, then it is not necessary to provide a mandrel 40 which is of such length that it extends to the cavity bottom. Rather it is sufficient to use a short mandrel of a flat shock-transmitting piston rod face which is at the same level as the active face of the annular pressure element 61 or integral therewith.

Mounting of the riser tube on the external surface of the collar portion has been illustrated in particular in FIGS. 2, 2A and 2B.

The inwardly curved lower rim portion 18 permits shortening of the workpath along which the valve head 125 has to be struck past the rim 118*a*, reduction of the free space above the first contact surface 126*a* between the internal wall of the collar portion 117 and the external surface of the valve stem 124, and facility of mounting the riser tube with a shorter upper end 137*a*, but firm seating owing to the sharp free terminal edge 118*e* of the crimped rim portion 118*d* cutting into the riser tube 137.

Terms such as "upper" and "lower" used in the instant specification and in the appended claims refer to the positions of the respective parts in the accompanying drawings, and "outward" and "inward" or similar terminology refers to the relationship of parts with regard to a container on which the valve-and-lid assembly is mounted, unless a different meaning is clearly derived from the context.

Compared with the structurally closest valve-and-lid assemblies of the prior art, the present invention offers a number of advantages. First of all, its assembling process is particularly simple in that the valve body and the lid are each produced separately in finished form by known manufacturing techniques. Assembling of the two parts is then carried out in the very simple manner described hereinbefore.

The separate production of the lid of specific configuration and of the novel valve body, both in finished form, permits manufacture of the assembly consisting of these two parts in a single short step with the possibility of exactly determining the various forces and automatically generating them in the assembled state, with an accuracy which it would be impossible to achieve if the finished form of the lid and/or the valve body were produced only after assembling the two parts in semi-finished conditions.

An important feature of the finished assembly resides in the fact that only a relatively small portion of the valve body, which is made of syntetic plastic material, such as Hytrel or rubber, comes into direct contact with the product during storage and when the product is released through the valve. Spaces that can retain residual product between two spraying operations, that may change its chemical nature with time and affect the composition and elasticity of the valve body material, are reduced to a minimum volume or completely eliminated.

This is due especially to the fact that the major portion of the product flow path extends through the interior of the valve body and not along its outside as is the case in the aerosol valve of Gildone, described supra, and it is especially advantageous when, in this case, the shaft of a spray or the like tubular actuating member extends downward into the interior of the valve body, surrounding the flowpath of product therethrough.

Another important distinctive feature of the valve-and-lid assembly according to the invention resides in the provision of additional sealing means about the valve stem which help to further limit the external surface area of the valve body which can come into contact with the product to be dispensed, and to reduce further the internal space in which product can accumulate and age between dispensing operations of the valve. At the same time, these sealing means also help to guide the valve stem in the lid collar portion and to ensure safe re-seating of the valve head on the obturating collar portion rim or shoulder after each actuation.

Excessive space between the valve stem and the inner wall of the lid collar portion above the obturation zone can also lead to an undesirable after-spray effect after the valve has again been closed at the end of dispensing product.

A further inventive feature of special advantage is the presence of a cavity which extends axially through the valve body to the vicinity of the level where the valve stem or neck merges with the larger diameter valve head constituting the lowermost end portion of the valve body.

In preferred embodiments of the valve-and-lid assembly according to the invention, the diameter, taken in a plane radial to the central assembly axis, of the flanged upper valve body portion is equal to or only slightly larger than the diameter, in a corresponding plane, of the valve head. In these cases, it is not necessary to confine the periphery of the annular flange comprised by such upper valve body portion in a special crimped peripheral portion in the lid dome of the assembly. Rather, the valve body is attached firmly within the collar portion of the lid by forces biassing the underside of the aforesaid flange and a rearward, i.e. upwardly directed annular face of the valve head toward each other and thereby exterting a clamping hold on the collar portion or a suitably shaped part thereof. In certain cases, the diameter of the upper valve body portion can even be smaller than the valve head.

In these embodiments as well as in others having a larger flange as the peripheral part of the upper valve body portion, and in those cases thereof when the actuating member such as a spray head shaft is of a diameter too large to permit insertion of the shaft into the valve body cavity, it is preferred to have the annular pressure area in which the spray head shaft or the like tubular acutating member exerts downward opening pressure on the upper frontal of the upper valve body portion coincide, or at least overlap with the annular area in which the lower end of the valve stem merges with the larger diameter valve head. This last-mentioned annular area is, of course, the area in which the downward pressure of the actuating member is transmitted to the valve head and moves the latter out of contact with the sealing surface of the lid collar portion opening the valve.

It is important that this annular pressure area on the upper valve body portion does not have too large a diameter to be substantially outside the said annular merging area of the valve stem and valve head, for, in short flange upper valve body portions, resting directly on the upper rim of the lid collar portion, this would make opening of the valve impossible, while, in the cases in which the upper valve body portion comprises a larger diameter flange downwardly bendable into a corresponding recess in the lid therebelow, the transmittal of forces moving the valve stem and valve head downwardly becomes the more uncertain and irregular, the greater the distance of the annular pressure zone from the merger zone between the valve stem and valve head, and the greater the flexibility of the material from which the valve body is made.

Self-closing valve-and-lid assemblies which can be produced by the process described hereinbefore are adapted for closing the open top end of the interior of a container fillable with pressurized product, and having a central assembly axis; such assembly comprises (I) a lid the periphery of which is adapted for being sealingly connected with a top rim of a container sidewall surrounding the said container top opening, and extending generally transverse to said central assembly axis, which lid has a central dome part and a central opening in the middle of the dome part, the lid having preferably a flat lid part about the said dome part and extending generally in a main lid plane transverse to the central assembly axis;

the dome part has a hollow interior extending between the open base end and the central dome opening and comprises a top portion, a circumferential sidewall which latter extends generally out of the main lid plane and has a foot zone merging with the flat lid part, and a collar portion protruding from the dome top portion and extending substantially axially relative to said central assembly axis and ending in an annular rim about said central dome part opening;

the said dome part has an inner annular wall surface of the top portion, sidewall, and collar portion delimiting the hollow dome part interior;

(II) a valve body having a peripheral disc portion, which valve body has an outer surface adapted for facing away from the hollow dome part interior and an opposite inner surface facing toward the hollow dome part inerior; this valve body comprises (a) a valve head bearing an annular contact zone being disposed coaxially about said central assembly axis, and being, in closed state, in sealing contact with at least one annular contact zone of the said inner wall surface of the dome part; and (b) a cavity open in the valve disc portion and extending inwardly toward the valve head, (c) at least one duct extending through the valve body and having a first orifice in the cavity thereof and a second orifice in the inner valve body surface and opening out of the latter surface between the annular contact zone of the valve head and the valve disc portion; and optionally (III) finger-engageable actuating means for deforming the valve body in a manner such that at least the part of the valve head bearing the annular contact zone is moved out of engagement with the annular contact zone of the inner wall surface of the dome part, thereby opening a free passage through at least one duct from a space adjacent the valve head about said annular contact zone to the said cavity, one of said lid and said valve body being rigid under conditions of filling product into, and discharging product from said container while the other one of said lid and valve body is elastically resilient under aforesaid conditions.

It is an object of another invention aspect to improve our earlier valve-and-lid assembly by providing a still better sealing between the two afore-mentioned annular contact zones and furthermore to facilitate the manufacture of the synthetic thermoplastic resin parts of such valve-and-lid assembly by injection molding techniques.

These objects and others will become apparent from the description of this invention aspect hereinafter, and are attained in accordance with the instant invention, in a valve-and-lid assembly as described hereinbefore, in which one of the said annular contact zones of the inner wall surface of the dome part and of said valve head is located in a conically tapered surface on one of the two last-mentioned parts with the central assembly axis as cone axis, and the other annular contact zone is a substantially circular edge on the other one of the two last-mentioned parts, opposite the said conically tapered surface.

In order to enhance the sealing effect of the inner annular contact zone at the dome part shoulder, the underside of the latter as well as the joint thereof with the collar portion can be spray-coated with a thin layer of flexible thermoplastic material (not shown) in all of the embodiments. Also, if this should be desired, a small thin-walled socket, of the resilient synthetic resin material having the shape of a tube of an outer diameter equall to the inner width of the dome part collar portion, and having a radial flange fitting on the underside of dome part shoulder can be press-seated in the same location as the spray-coating, taking the place of the latter.

Instead of an atomizer head, the tubulure can also carry a filling head in order to fill a suitable product and/or propellant into the container.

The terms "upward", "downward", "upper side" and the like, e.g., "lower side" or "underside" refer to positions of the respective parts as shown in the accompanying drawings, while "inner" and "outer" refer to the position of parts relative to the container which can be closed by the valve-and-lid assembly according to the invention, unless defined otherwise.

Figures 11, 12, 13:
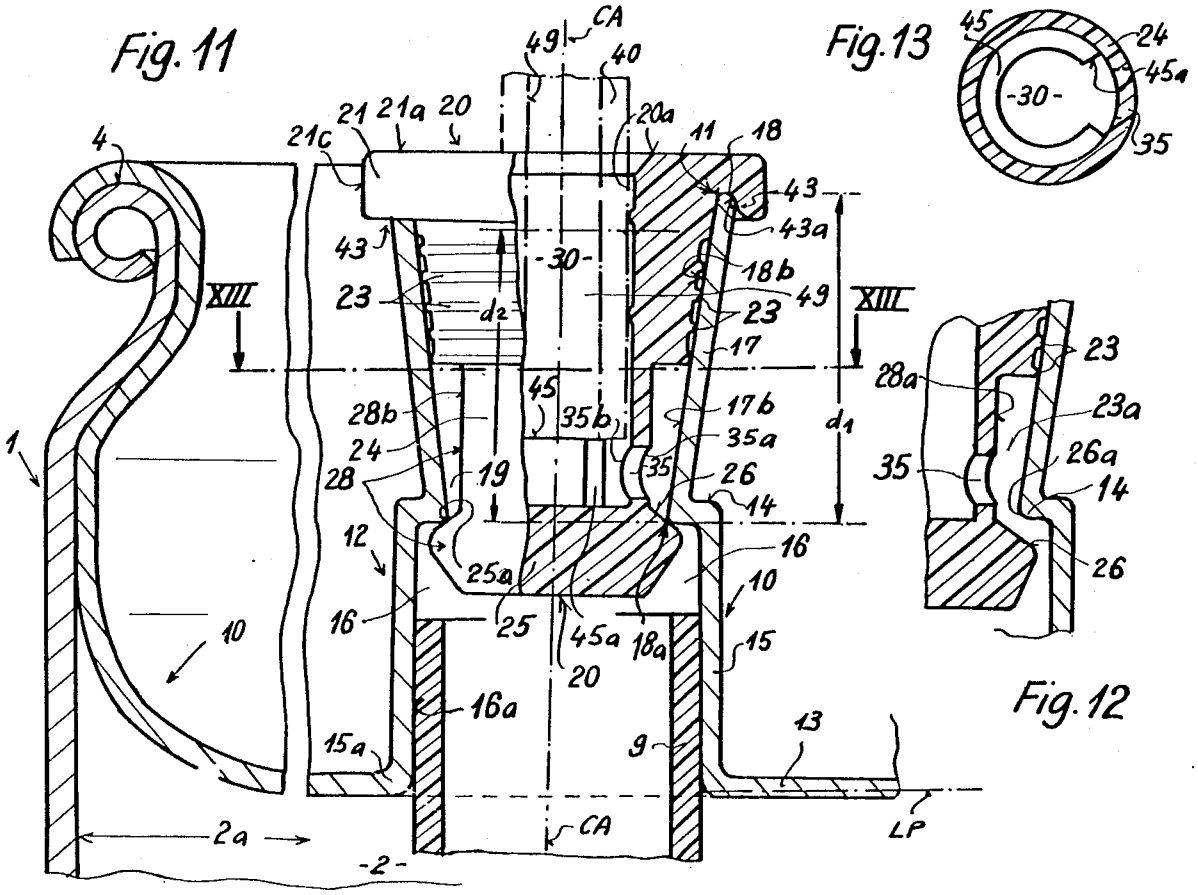
Figure 14:
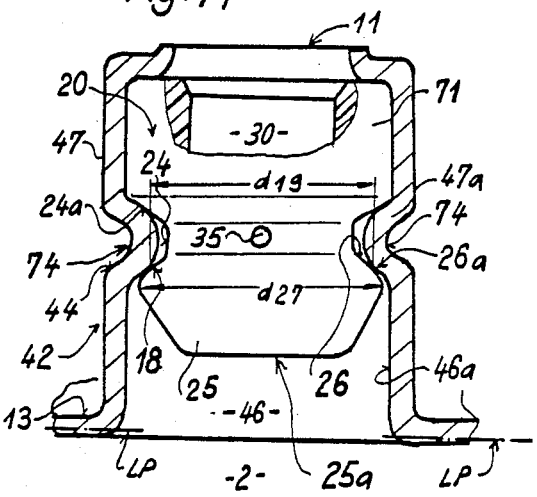
Figure 15:
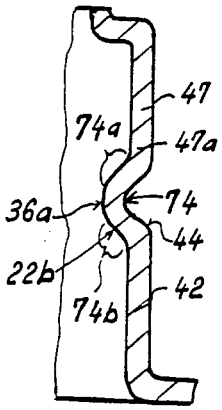

Other features and details of this invention will become apparent from the further description thereof with reference to the accompanying drawings in which FIG. 11 is an axial sectional view through a further embodiment of the valve-and-lid assembly according to the invention with the parts in closed position;

FIG. 12 shows a detail of the view of FIG. 1, with the parts in open position;

FIG. 13 is a cross-sectional view of the valve body in the same embodiment taken in a plane indicated by XIII—XIII in FIG. 11;

FIG. 14 shows a third embodiment in axial, partially sectional view;

FIG. 15 is a partial view, in axial section, of the lid part of the same embodiment as shown in FIG. 4.

Figure 16:
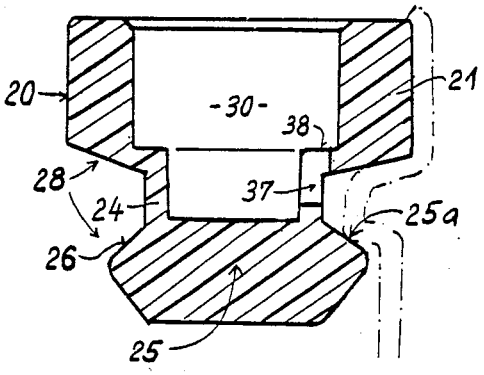
Figure 17:
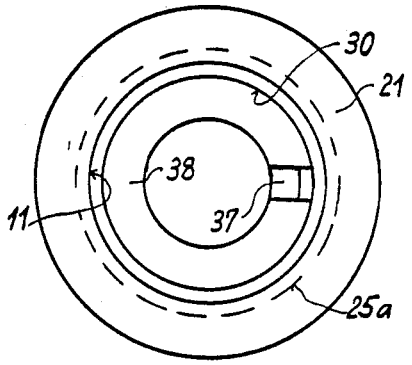
Figure 18:
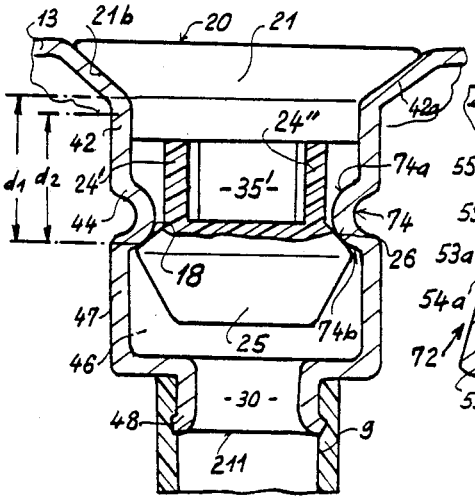
Figure 19:
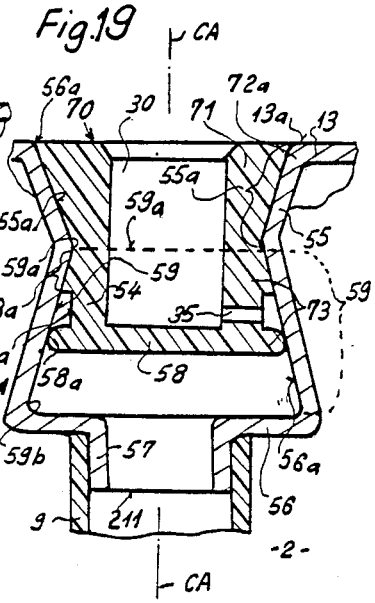
Figure 20:
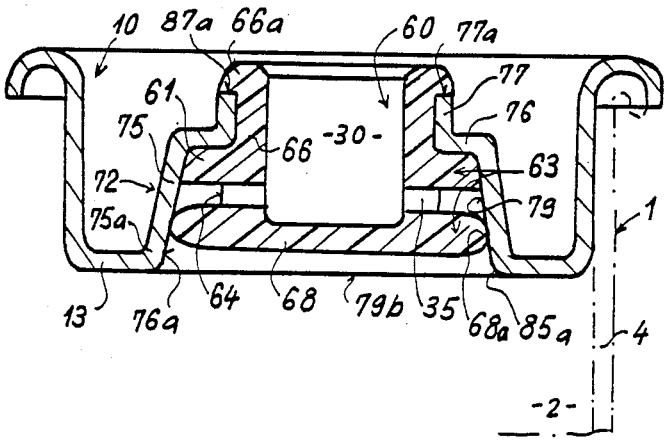
Figure 21:
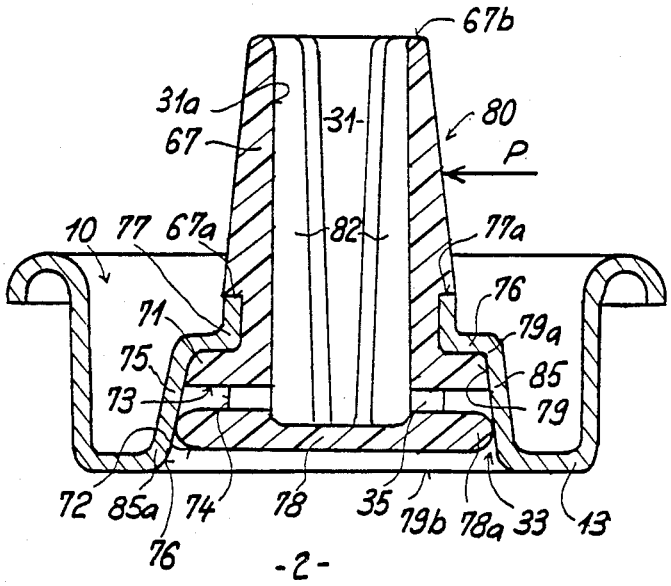
Figure 22:
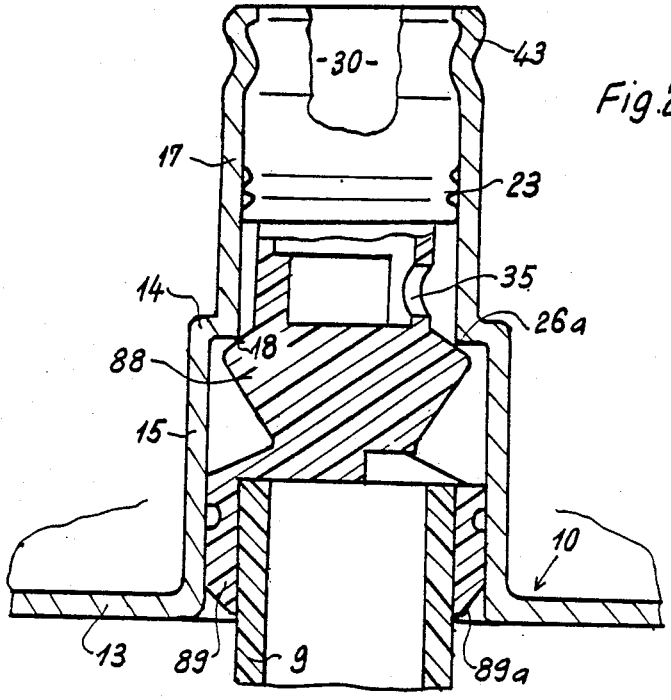
Figure 23:
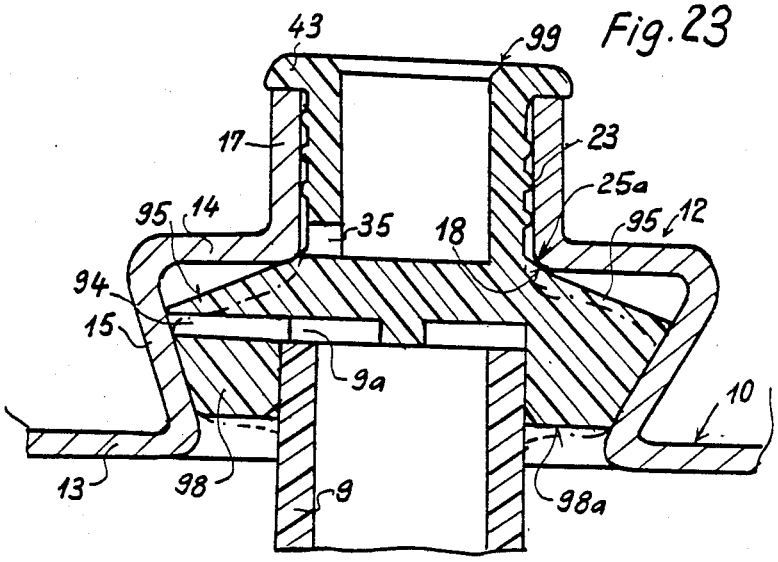

FIG. 16 is an axial sectional view of a valve body similar to that shown in the embodiment of FIG. 4;

FIG. 17 is a top view of the same valve body as shown in FIG. 6;

FIG. 18 is an axial partially sectional view of a fourth embodiment of the valve-and-lid assembly according to the invention, with the parts in closed position;

FIGS. 19, 20 and 21 are axial sectional views of, respectively, a fifth, sixth and seventh embodiment of the invention; and FIGS. 22 and 23 are axial sectional views of, respectively, an eighth and ninth embodiment of the invention.

Figure 24:
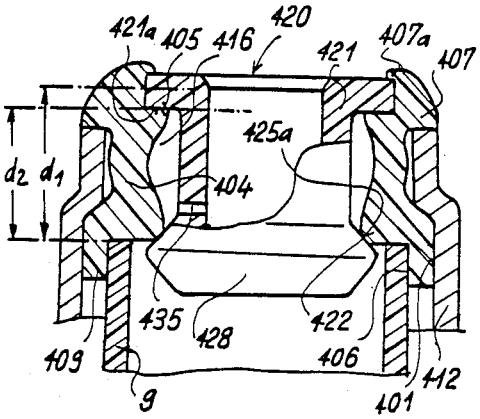
Figure 25:
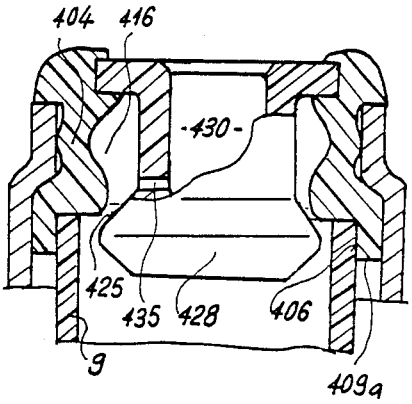

FIG. 24 is an axial sectional view of a tenth embodiment of the valve-and-lid assembly according to the invention, in closed position, and FIG. 25 is a similar view of the tenth embodiment but with the parts in open position.

In several figures of the drawings, parts having like functions bear like numerals.

In the embodiment of a self-closing valve-and-lid assembly according to the invention shown in FIGS. 11 to 13, the top opening 2*a* of a container 1 is closed by the lid 10 of the said assembly. The periphery of an annular flat lid part 13, which extends generally transverse to a central assembly axis CA in a main lid plane LP, is sealingly connected by crimping to the top rim 4 of the container sidewall. The lid 10 has a central dome part 12 protruding upwardly from the flat lid part 13. The dome part 10 comprises a circumferential sidewall 15 which extends from its foot zone 15*a*, merging with the flat lid part 13, upwardly, i.e away from the container interior 2, and is covered by a top portion 14 of the dome part. The top portion 14 bears, preferably centrally disposed, a collar portion 17 which protrudes from the dome top portion 14, preferably in a direction away from the lid plane LP, and extends axially relative to the central assembly axis CA. The collar portion 17 ends in an annular rim 18 about the central dome part opening 11, and at least the outer part 18*b*, adjacent the rim 18, of the collar portion internal sidewall 17*b* is flared outwardly.

The dome part 12 has an inner annular wall surface 16*a* which extends inside the sidewall 15, top portion 14 and collar portion 17 and delimits the hollow interior 16 of the dome part 12.

At the junction between the collar portion 17 and the top portion 14, there is formed a rounded shoulder 18*a* in the inner wall surface 16*a*. The latter surface 16*a* is preferably of cylindrical configuration inside the dome part sidewall 15, and has a narrower diameter inside the collar portion 17.

In the hollow interior 16 of the dome part 12, there is seated a valve body 20 of a material which is sufficiently elastically resilient to allow at least some deformation when pressure is applied to one end of the valve body, as shall be explained in more detail hereinafter. Elastically resilient materials for making such valve bodies have been described in the initially mentioned earlier patent application.

This valve body 20 has a generally plate-shaped or block-shaped base or disc portion 21 the periphery 21*c* of which is preferably broader than the remainder of the valve body 20. Those regions of the surface of the valve body 20 which face away from the hollow dome part interior 16 are referred to as the outer surface 20*a*, and those regions thereof which face toward the hollow dome part interior, i.e., the inner annular wall surface 16*a* of the dome part interior 16, are referred to as the inner surface 28*b*, of the valve body 20.

The valve body 20 also comprises a valve head 28 which is connected with the valve body disc portion 21 and preferably integral therewith. In the embodiment of FIG. 1, the valve head 28 comprises a broader valve head end portion 25 and a narrower valve stem 24 connecting the head end portion 25 preferably integrally with the disc portion 21.

In its outer surface 20*a*, in the disc portion 21, the valve body 20 is provided with a preferably cylindrical cavity 30 which opens out of the disc portion 21 in the top face 21*a* of the latter.

At least one channel or duct 35 extends through the valve stem 24 and has an inner orifice 35*b* opening into the cavity 30 and an outer orifice 35*a* opening into the hollow interior 16 in a space 23*a* thereof located between the inner surface 28*b* of the valve body 20 and the inner annular wall surface 17*b* of the collar portion 17 of the dome part 12, on the one hand and intermediate annular labyrinth-type sealing means 23 about the stem part 24 adjacent the disc portion 21 and a passage 33 (FIG. 1A) between shoulder 18 and a conically tapered annular surface part 26 of the valve head end portion 25, which passage 33 is obturated, when the parts of the valve are in closed position, by the conically tapered head surface part 26 being urged with a contact zone 25*a* thereof into sealing contact with a circular contact rim 18*a* at the aforesaid rounded shoulder 18 of the dome part top portion 14 and sidewall 15.

When in obturating position, the valve body 20 is firmly set in the dome part 12 under bias due to the fact that the axial distance $d_1$ between the rim 18*a* and the shoulder 18 is larger than the axial distance $d_2$ between the bottom of an annular groove 43*a* in a flange 43 about the periphery of valve disc portion 21, and the annular contact zone 25*a* of the conically tapered valve head surface part 26, while the valve body 20 is in unassembled condition, i.e. while it is not seated in the dome part 12 of the lid 10.

In order to be able to actuate the valve of this valve-and-lid assembly, an actuating tube 40 which has an internal discharge duct 49 and may bear at its free end a conventional spray nozzle head (not shown) is inserted in the cavity 30 and comes to rest on an annular shoulder 45 having a gap 45*a* for the passage of product. (FIG. 3).

When actuating tube 40 is depressed by the user's finger or fingers, the lower end of tube 40 presses on the shoulder 45 downwardly in axial direction, thereby stretching in particular the thin-walled neck portion 24 of the valve body by a millimeter or even less and thus moves the valve head end portion 25 downward and its surface part 26 out of sealing contact with the circular contact edge 18*a* of the shoulder 18 between top portion 14 and sidewall 15 of the lid dome part 12, thus freeing the passage 33 through the valve so that product can be discharged therethrough from the interior 2 of the container 1. (FIG. 2).

When finger pressure is relieved from actuating tube 40, the bias in the valve body 20 due to the difference between $d_1$ and $d_2$ as well as the elastic resetting forces in the valve body material cause the valve stem 24 to contact and the passage 33 to become again obturated.

It must be borne in mind that, in practice, the dimensions of, for instances, the valve body 20, can be very small ones. Thus the largest diameter of the periphery of the valve head end portion can be as small as 5.4 mm, the width of the orifice 35 can be 1 mm, the entire length of the valve body 20 only 9.5 mm. This means very exact dimensioning when producing the valve body 20 by injection molding techniques, and even a small change facilitating the production of the valve body 20 and/or making it more accurate can be highly cost effective.

In the preferred embodiment shown in FIGS. 14 and 15, the valve body 20, apart from its disc portion 21, is largely identical with the valve bodies of the preceding embodiments, except that its stem portion 24 is particularly short.

The dome part 42 of the lid 10, which protrudes in this embodiment from the flat lid part 13 in the direction away from the interior 2 of a container 1, comprises, at the junction between the top portion 44 of the dome part sidewall and the foot zone 47*a* of the collar portion 47, an annular indentation 74 of reduced diameter and of a wall which shows a concavely curved cross section, i.e. the crest 36*a* of the indentation 74 protrudes into the hollow dome part interior 46 in a plane perpendicular to the central assembly axis CA. This indentation thus has, as part of the inner dome part wall surface, a first flank or slope 74*a* facing outwardly, i.e. away from the container interior, and, below the crest 36*a*, a second flank or slope 74*b* which faces toward the container interior. In the embodiment of FIGS. 14 and 15, it is the latter flank 74*b* which contains the circular edge 18*a* which makes contact with the opposite conically tapered head end portion surface part 26, in the annular contact zone 25*a* of the latter.

FIG. 15 shows in axial sectional view a part of the dome part of the embodiment of FIG. 14, from which the valve body 20 has been removed.

The annular recess about the stem part 24 of the valve head 20 in FIG. 14 is so dimensioned that a bias is exercised on the two flanks 74*a* and 74*b* by the conically tapered slopes 24*a*, of the disc portions, and 26, of the head end portion 25, above and below the neck portion 24, respectively.

In FIGS. 16 and 17 there is shown a preferred embodiment of the valve body 20 which can be manufactured by injection molding without the use of needles.

In this valve body 20, the duct 35 is replaced by a recess 37 in the annular shoulder 38 near the bottom end of cavity 30. The mold to be injected in the production of this valve body can thus consist of two halves which are both axially withdrawn, one upward and the other downward, while no use of transverse needles is required.

The embodiment shown in FIG. 18 is distinguished from that of FIG. 4 mainly by the fact that the dome part 42 protrudes from the flat lid part 13 in the opposite direction, namely inwardly toward the container interior 2, and the collar part 47 has about the central opening 211 thereof a rim 48 which bears a riser tube 9, of standard size as used conventionally in spray cans.

In this embodiment, two exit openings 35' of large cross section are provided, whereby the remaining stem part takes the shape of two columns 24' and 24''.

The valve body 20 is firmly seated in the dome part 42 in a similar manner with bias due to the difference between $d_1$ and $d_2$ as has been explained, supra, in connection with the embodiment of FIG. 11. This bias of valve body 20 also contributes to an enhanced sealing effect between the annular conical face 21*b* about the periphery of the disc portion 21 and the outwardly flared foot zone 42*a* of the dome part 42, which merges with the flat lid part 13, on the one hand; and with collar part 47, on the other hand, to achieve an enhanced sealing effect between the inner flank 74*b* of the dome part indentation 34 and the conically tapered surface part 26 of head end portion 25 of the valve body 20.

In the embodiments of FIGS. 19, 20 and 21, the dome part has in its sidewall a zone of frustoconical configuration which, in closed position of the valve parts, is in sealing contact with a rounded peripheral zone of the head end portion of the valve body.

More in particular, in the embodiment of FIG. 19, the dome part 52 projects downwardly from the flat lid part 13 toward the interior 2 of a container. The inner annular dome part wall surface 56*a* has an annular zone 59 which is of frustoconical configuration. The narrower end of this zone has a periphery 59*a* approximately at half the axial length of the dome part sidewall 55, while the opposite broader base end of the frustoconical zone has a larger diameter periphery 59*b* which, in this embodiment extends in the plane of the top portion 56 of the dome part 72. From the top portion 56, there protrudes downwardly a collar position 57, which bears firmly seated thereon, a conventional riser tube 9 leading into the central opening 211 of the dome part 52.

The annular zone 55*a* of the inner dome part wall surface 56*a* extending from the aforesaid narrower end periphery 59*a* of the annular zone 59 to the foot zone 72*a* of the dome part 72, at the flat lid part 13, is likewise of frustoconical configuration, having as its narrower end periphery the same periphery 59*a* as the first-described frustoconical zone 59 while its broader base end has its periphery at the said foot zone 72*a* where the inner annular dome part sidewall surface 56*a* ends at the outer surface 13*a* of the flat lid part 13.

The narrowest diameter of the dome part sidewall 55 is at the level of the narrower end periphery 59*a* which is common to the two frustoconical zones 55*a* and 59. The phantom apexes of the two generating cones are both located on the central assembly axis CA.

The valve body 70 which is particularly easy to assemble in the dome part 72 has a configuration which differs somewhat from those of the preceding embodiments. Its disc portion 71 is of frustoconical shape and, prior to its introduction into the dome part 72 of preferably slightly flatter inclination toward its base than the corresponding zone 55*a* of the dome part sidewall 55, the diameter of disc portion 71 at the base end of the frustoconical zone thereof being slightly larger than the open end, surrounded by the foot zone 72*a*, of the dome part 72. The valve head 58 is also generally of frustoconical shape with its narrower end face merging with the frustoconical disc portion 71 at the narrow end of the latter, the diameter of this common narrower end merging plane of the disc portion 71 and the head 73 being practically identical with the diameter of the narrower end periphery 59*a*, of the narrowest width, of the inner dome part wall surface 55*a*, 56*a*.

Prior to its introduction into the dome part 72, the frustoconical sidewall 53*a* of valve head 73 is very slightly less inclined than the corresponding frustoconical zone 59 of the inner dome part sidewall surface in contact therewith.

Upon insertion of the valve body 70 into the hollow interior of the dome part 72, this configuration causes particularly safe seating and simultaneously very safe sealing between the two valve parts.

In the frustoconical surface 53*a* of the valve head 73, there is provided an annular groove 54*a*, leaving a reduced diameter neck portion 54 and, below the groove 54*a*, toward the base end, of the frustoconical valve head a larger diameter head end portion 58, the periphery 58*a* of which has a rounded contour, so that a circular edge thereon makes sealing contact with the bevelled surface of frustoconical zone 59.

The valve disc zone 71 and stem portion 54 contain the cavity 30 and a duct or ducts 35 in the same manner as is the case in the preceding embodiments of the valve body 20. Insertion of an actuating tube 40 in the cavity 30 permits to open the valve by downward pressure, whereby the neck portion 54 is slightly stretched, for instance by about one millimeter, and a gap is opened between the downwardly displaced rounded periphery 58*a* of the head end portion 58 and the above mentioned inner dome part wall surface 56*a* in the zone 59 thereof.

In the embodiments of FIGS. 20 and 21 the sealing effect and the opening and closing operation are the same as in the embodiment of FIG. 19.

In these two figures, dome part 72 protrudes upwardly from the flat lid part 13, i.e. away from the interior 2 of a container 1 equipped with this valve-and-lid assembly. The inner surface 76*a* of the sidewall 75 of dome part 72 has a frustoconical zone 79 which extends up to the dome part top portion 76, where the narrower end periphery 79*a* of the zone 79 is located, while the broader base periphery 79*b* is located at the foot zone 75*a* of the dome part sidewall 75.

The top portion 76 of the dome part 72 bears a collar portion 77 the rim 77*a* of which surrounds the central opening of the dome part 72.

In the embodiment of FIG. 20, a valve body 60 is inserted in the hollow interior 76*a* of the dome part 72, the valve stem portion 64, and valve head end portion 68 are of identical configuration with those of the valve head 70 in the embodiment of FIG. 20. Thus the head end portion 68 has a rounded peripheral contour at 68*a* which sealingly engages the frustoconical zone 79 of the inner dome part wall surface 76*a* when the valve parts are in closed position.

The disc portion 61 of the valve body 60 comprises on its outer side, facing away from the container interior 2, a sleeve portion 66 which bears an external, radially projecting flanges 66*a* and is snugly and sealingly fitted into the collar portion 77 of the dome part 72, with the underside of the flange 66*a* resting firmly on the flat rim 77*a* of the collar portion 77. The valve body 60 is provided with a cavity 30 and at least one duct 35 in an identical manner as in the preceding embodiments.

In FIG. 21 there is shown the same lid 10 and dome part 72 as in the embodiment of FIG. 21. The valve body 70 comprises a similar valve head 73 with head end portion 78 and rounded periphery 78*a*, stem portion 74 and disc portion 71. However, the latter bears a tubular member 67 as actuating means integral with the disc portion 71 and having an annular projection or shoulder 67*a* the underside of which rests on the rim 77*a* of the collar portion 77 when the valve parts are in unactuated position and the valve is closed.

The tubular member 67 has an elongated cavity 31 which reaches down into the valve neck portion 74, and at least one duct 35 is provided in a similar manner as in the preceding embodiments.

In order to actuate the valve in the embodiment of FIG. 21, lateral finger pressure is exerted on one side of the tubular member 67, preferably in the direction indicated by arrow P, whereby the tubular member 67 is tilted to the right in FIG. 21, i.e. toward the side on which the duct 35 is located. Thereby, that side of the valve body 70 is compressed while the opposite side is stretched in an outward direction. This causes a slight lifting of the left hand region of the rounded periphery 78*a* of head end portion 78, and a slight lowering of the opposite, right hand side in FIG. 21, whereby a small gap at 33 is produced between the rounded peripheral edge 78*a* of head portion 78 and the frustoconical zone 79 of the dome part sidewall 75 through which gap product under pressure can pass from the container interior 2 to the duct 35 and out of cavity 31.

In order to increase this deformation of the valve body 70, axially extending stiffening ribs 82 are preferably provided integrally with the interior sidewall 31*a* of the cavity 31 which extend from the top face 67*b* of the tubular member 67 down to the bottom of the cavity, the inner orifices of ducts 35 opening between these ribs 82 into the cavity 31.

In the embodiments of FIGS. 22 and 23 the valve head end portion 88 or 98 is sufficiently enlarged by a dependent socket 89 in the case of end portion 88, so that a riser tube 9 can be fastened in the underside 89*a* or 98*a*, respectively, of the valve head. In the embodiment of FIG. 23, the riser tube 9 has a lateral opening or recess 9*a*, in its upper end, which is in free communication with a channel 93 which extends transversely to the peripheral portion 98*a* or the conical surface 95 of the valve body 99.

The sealing effect between contact faces of the valve body and dome part shoulder as well as the actuating of the valve in order to release product under pressure therethrough are identical with those of embodiments of similar configuration described hereinbefore.

A particularly advantageous feature of the embodiment shown in FIGS. 19, 20 and 21 resides in the conical configuration of the dome part sidewall of zone 59 in FIG. 19 and 75 in FIGS. 20 and 21, and of the correspondingly slightly flatter configuration of the frustoconical mantle which envolves the head part 53, 63, 73 of the valve body 60, 70. This figure affords a much safer seating and, in particular, sealing than if the dome part sidewall and the corresponding configuration of the valve head were cylindrical, i.e., coaxially with the central assembly axis CA.

The dome wall part 12 of the lid 10 or a part of the latter surrounding the dome part can also be made integral with the sidewall of a container 1.

Moreover, in the embodiments of FIGS. 11, 14, 20 and 21 the collar portion 17 of the dome part 12 can be made shorter and there can be inserted a stoper-like lid piece 101 of a different kind. Such an embodiment is illustrated in FIGS. 24 and 25 herein. The inner wall surrounding the central opening 408*b* of the lid piece 401, which is cylindrical in certain cases can also be of frustoconical configuration in the same manner as shown by the dome part sidewall 75 in FIGS. 20 and 21 described herein before. Preferably, the lid piece 401 is provided in its central region with a flexible wall zone 404 of reduced thickness of a flexible, compressible wall region 404 between a valve bodysupporting upper face 405 on which the disc portion 421 of the valve body 420 rests while being clamped in position by an inwardly directed flanch 107*a* of an outer upper sidewall 407 of the lid piece 401. At its lower end, the compressible wall region 404 merges with the foot portion 409 of the lid piece 401 which slightly projects inwardly to form a contact shoulder 422 which is in sealing contact with an outwardly and downwardly flared conical surface 125 of the valve body head 428. Prior to the insertion of the valve body 420 in the hollow interior 416 of the lid piece 401, the axial distance between the contact shoulder 422 and the upper lid piece face 405 is slightly larger than the distance $d_2$ between the underside 421*a* of the valve disc portion 421 and the contact zone 425*a* on the conically tapered surface 425 of the valve body head 428. Thereby, when the valve body 420 has been inserted in the lid piece 401, a flexible wall 404 is pre-tensioned, so that its face 405 and its shoulder 422 are in hermetically sealing contact with the respective parts of the valve body 420 which they engage. The lid piece 401 is firmly held in central opening of the dome part 412 of a lid or of a container wall, as described herein before.

In a recess 406 in its underside 409*a* it can firmly hold a riser tube 9.

In contrast to the embodiment illustrated in the FIGS. 1 to 23, in which the lid and the dome part being integral with each other are made of a material which is rigid under the conditions of filling product into, and discharging product from a container, i.e., a metal such as aluminium, while the valve body is made of an elastically resilient material, e.g., a synthetic thermoplastic resin, in the case of the embodiment shown in FIGS. 24 and 25, the valve body 420 is preferably made of a relatively rigid synthetic resin, while the lid piece 401 is made of a relatively soft, elastically resilient thermoplatic material, such as Hytrel ®.

We claim:

1. A process for producing a valve-and-lid assembly comprising a lid and a valve body, which assembly has a central assembly axis and is adapted for closing the open top end of a container, which process comprises the steps of (A) producing, in finished condition, a lid, being rigid under conditions of filling product into, and discharging product from the interior of said container, the periphery of which lid is adapted for being sealingly connected with a top rim of a container sidewall surrounding the said open container top end, and which lid extends generally on a main lid plane transverse to said central assembly axis; said lid having a dome and a central opening in the middle of said dome;

at least a portion of said dome being an axially extending collar portion having an outer end zone destined to face away from, and an inner end zone destined to face toward, the interior of said container, and comprising at said inner collar end zone, an annular rim or shoulder edge about said central opening and adapted for sealing contact with said valve body, in a first contact zone of the latter;

(B) producing separately, from a synthetic resin of physical properties corresponding to those of Hytrel, with a Shore hardness A in the range of about 78 to 92, said valve body in finished condition, which valve body comprises (a) a radially extending upper valve body portion having an outwardly facing upper surface, and an inwardly facing lower surface of a diameter larger than the diameter of said outer end zone of said collar portion, (b) a valve stem centrally and axially protruding from said inwardly facing upper body portion surface and adapted for being lodged in said lid dome collar portion, (c) a valve head at an end of said valve stem remote from said upper valve body portion and having a diameter, transverse to said central assembly axis, which is larger than the diameter of said valve stem; said valve head bearing said first annular contact zone so located thereon as to face, in the finished assembly, toward the inner collar end zone of said collar portion, and being adapted for making sealing contact with said annular rim or shoulder edge, when the assembly is in closed position, and, when said assembly is in open position, forming a gap therewith, (d) a cavity having an opening in said upper surface of said upper valve body portion and extending axially at least into said valve stem and having a bottom end located near the radial plane in which said first contact zone on said valve head extends, and a determined axial depth from said valve body upper face to said cavity bottom end, at least one of said upper valve body portions and said valve stem having an annular elastically resilient valve portion being deformable toward or in, axial direction, (e) additional annular sealing means about said valve stem spaced from said valve head and adapted for making sealing contact at all times with said lid dome collar portion in a second zone axially spaced from said first contact zone, (f) and duct means in said valve stem, having an exit opening for product flow into said cavity and an entry opening in a region of said valve stem extending from said first to short of said second contact zone;

(C) introducing said valve body into a part of said collar portion outside said central dome opening, and on a mandrel of such diameter as to fit axially and substantially snugly into said cavity and protruding from an annular frontal end face of a piston movably associated with a pressure cylinder, the frontal end face of which piston has an external diameter substantially larger than the cross-sectional diameter of said cavity in said upper surface of said upper valve body portion; said mandrel having a tip and an axial length greater than said determined axial depth of said cavity of the valve body when in undeformed state;

(D) striking said mandrel with sufficient force to drive the same together with said valve body abruptly into said collar portion of said lid dome with an impact pressure of about 2 to 8 bars depending on the Shore hardness of the valve body material; the distance by which the axial length of said mandrel exceeds said axial cavity depth and the length of travel of said mandrel during each stroke being sufficient to pass said valve head a short distance downwardly out of the annular rim or shoulder edge said central dome opening, with a limited stretching deformation of said elastically resilient valve portion;

(E) stopping the advance of the mandrel and the piston bearing the same when the mandrel has passed through said short distance; and (F) withdrawing said mandrel upwardly out of engagement with said valve body, whereby said elastically resilient valve body portion contracts and moves said first contact zone of said valve head into sealing contact with said annular rim or shoulder edge at the central opening in said inner end zone of said dome collar portion.

2. A process as described in claim 1, wherein, in step B, said valve body is produced with at least one annular region of said valve stem intermediate said inner surface of said upper body portion and said first annular contact zone being axially stretchable.

3. A process as described in one of claims 1, wherein, in step C, said mandrel protrudes into said valve body cavity from said outer valve body surface and has a flat-nosed tip which rests against said cavity bottom.

4. A process as described in claim 1, wherein the diameter of said disc is such that the peripheral zone of said inner valve disc surface is approximately equal with, or slightly larger than, an underlying radially extending rim portion of the lid dome.

5. A process as described in claim 1, wherein the thrust of the mandrel corresponds to a force of at least 15 to 25 kiloponds.

6. A process as described in claim 1, wherein the work path corresponding to the length of said collar portion offering resistance to the passage of said valve head therethrough ranges from 0,5 to 5 millimeters.

7. A process as defined in one of claims 1, 2, 3, 4, 5, 6 inclusive, in step A of which said lid is produced from a metal of the aluminum type.

8. A process as defined in claim 1 further comprising the step of mounting said lid in the top opening of a container and sealingly connecting a periphery of said lid with a top rim of said container about said top opening thereof.

9. The process of claim 1, wherein such mandrel is of such length that, in Step (E), said annular frontal piston surface from which said mandrel protrudes, simultaneously impacts on said upper surface of said upper valve body portion and slightly compresses the latter and urges said additional annular sealing means into sealing contact with a region of said collar portion near or at the outer end zone thereof.

10. A process for producing a valve-and-lid assembly comprising a lid and a valve body, which assembly has a central assembly axis, and is adapted for closing the open top end of a container, which process comprises the steps of (A) producing, in finished condition, a lid, being rigid under conditions of filling product into, and discharging product from the interior of said container, the periphery of which lid is adapted for being sealingly connected with a top rim of a container sidewall surrounding the said open container top end, and which lid extends generally on a main lid plane transverse to said central assembly axis; said lid having a dome and a central opening in the middle of said dome;

at least a portion of said dome being an axially extending collar portion having an outer open end zone destined to face away from, and an inner end zone containing said central opening and being destined to face toward, the interior of said container, and comprising at said inner collar end zone, an annular flange about said central opening and projecting from said collar portion transversely with regard to, and toward said central assembly axis; and further comprising in said outer open end zone, crimp means projecting from said collar portion toward said central assembly axis;

(B) producing separately, from a synthetic resin of physical properties essentially corresponding to those of rubber, with a Shore hardness A of about 70 to 92, said valve body in finished condition, which valve body comprises (a) an axially elongated upper valve body portion having an outwardly facing upper surface, and an inwardly facing lower surface of a diameter substantially equal with the diameter of said outer open end zone of said collar portion, (b) a valve stem centrally and axially protruding from, and being surrounded by an annular shoulder of, said inwardly facing surface of said upper body portion, and adapted for being lodged in said central opening in said inner collar end zone, (c) a valve head at an end of said valve stem remote from said upper valve body portion and having a diameter, transverse to said central assembly axis, which is larger than the diameter of said valve stem; said valve head bearing said first annular contact zone so located thereon as to face, in the finished assembly, toward the inner collar end zone of said collar portion, and being adapted for making sealing contact with said annular rim or shoulder edge, when the assembly is in closed position, and, when said assembly is in open position, forming a gap therewith, (d) a cavity having an opening in said upper surface of said upper valve body portion and extending axially at least into said valve stem and having a bottom end located near the radial plane in which said first contact zone on said valve head extends, and a determined axial depth from said valve body upper face to said cavity bottom end, at least one of said upper valve body portion and said valve stem having an annular elastically resilient valve portion being deformable toward or in, axial direction, (e) and duct means in said valve stem, having an exit opening for product flow into the bottom end of said cavity and an entry opening in a region in which said valve stem merges with said valve head, above said first contact zone;

(C) introducing said valve body into a part of said collar portion outside said central dome opening, and on a mandrel of such diameter as to fit axially and substantially snugly into said cavity and protruding from an annular frontal end face of a piston movably associated with a pressure cylinder, said mandrel having a frontal end face adapted for impacting on the surface of said cavity bottom end, said mandrel having a tip and an axial length greater than said determined axial depth of said cavity of the valve body when in undeformed state;

(D) striking said mandrel with sufficient force to drive the same together with said valve body abruptly into said collar portion of said lid dome with an impact pressure of about 2 to 8 bar, depending on the Shore hardness of the valve body material; the distance by which the axial length of said mandrel exceeds said axial cavity depth and the length of travel of said mandrel during each stroke being sufficient to pass said valve head a short distance downwardly out of the annular rim or shoulder edge said central dome opening, with a limited stretching deformation of said elastically resilient valve portion, and simultaneous pulling said upper valve body portion into said collar portion and below said (annular crimp means,)

(E) stopping the advance of the mandrel and the piston bearing the same when the mandrel tip has passed through said short distance; and (F) withdrawing said mandrel upwardly out of engagement with said valve body, whereby the latter contracts to move said first contact zone of said valve head into sealing contact with said annular rim or shoulder edge on the outside of said dome collar portion.

11. The process of claim 10, wherein said collar portion of said dome part has at said outer open end zone thereof, annular crimp means extending radially a short distance toward said central assembly axis, and, in step (F), upon withdrawing said mandrel upwardly out of engagement with said valve body, the upper surface of said upper valve body portion will sealingly engage said crimp means.

12. The process of claim 10, wherein said cavity of said valve body has a reduced diameter downward extension into said valve head, and said mandrel has a downward extension protruding from said mandrel frontal end face inside an annular portion thereof and having greater axial length than said cavity extension, thereby urging, said valve head, during Step (E), through said central opening with slightly greater elongation of said valve stem than is exerted on said upper valve body portion by said annular portion of said mandrel frontal end face impacting on said cavity bottom end about said downward extension of the latter.

* * * * *